US006122472A

United States Patent [19]

Sako et al.

[11] Patent Number: 6,122,472

[45] Date of Patent: Sep. 19, 2000

[54] DEVELOPING APPARATUS HAVING IMPROVED DEVELOPER DISTRIBUTION

[75] Inventors: Mineyuki Sako, Toyokawa; Shinichi Yoshimoto, Aichi-Ken; Suguru Hamamichi; Yukihiko Okuno, both of Toyokawa, all of Japan

[73] Assignee: Minolta Co., Ltd., Osaka, Japan

[21] Appl. No.: 09/172,277

[22] Filed: Oct. 14, 1998

[30] Foreign Application Priority Data

| | | | |
|---|---|---|---|
| Oct. 14, 1997 | [JP] | Japan | 9-280199 |
| Oct. 20, 1997 | [JP] | Japan | 9-287008 |
| Nov. 10, 1997 | [JP] | Japan | 9-306928 |

[51] Int. Cl.[7] ..... G03G 15/08

[52] U.S. Cl. ..... 399/254; 399/255; 399/256

[58] Field of Search ..... 399/254, 255, 399/256, 258, 260, 262, 263, 228; 222/DIG. 1; 366/279, 292, 294, 318, 319, 320

[56] References Cited

U.S. PATENT DOCUMENTS

| | | | |
|---|---|---|---|
| 4,928,144 | 5/1990 | Kasahara et al. | 399/228 |
| 4,940,014 | 7/1990 | Saijo et al. | 399/256 |
| 5,220,382 | 6/1993 | Hediger | 399/256 |
| 5,495,320 | 2/1996 | Araki et al. | 399/256 |
| 5,682,584 | 10/1997 | Hattori et al. | 399/255 |
| 5,758,238 | 5/1998 | Mordenga et al. | 399/256 |

FOREIGN PATENT DOCUMENTS 5-333691 12/1993 Japan .

*Primary Examiner*—William Royer
*Assistant Examiner*—Hoan Tran
*Attorney, Agent, or Firm*—Burns, Doane, Swecker & Mathis, LLP

[57] ABSTRACT

The present invention is to provide a developing apparatus having a supply screw and a recovery screw both of which are arranged vertically to circulate developer, wherein a component in a normal direction of pressure generated by the recovery screw is made larger than that of pressure generated by the supply screw. Thereby, lowering and raising of developer is suppressed and occurrence of fog on the image and the smoke of toner are prevented. Alternatively, a radial member and a centrifugal member are applied to the supply screw and the recovery screw, respectively. Thereby, developer is prevented from moving between screws in the midst of the transportation. Still alternatively, a preliminary stirring portion is provided on extension of a stirring screw at upperstream side. The preliminary stirring portion has a cylindrical body with inlets and outlets. Both inside and outside of the cylindrical body, screws are provided and inclines of screw blades are reversed to each other. Thereby, it enables the developing apparatus to transport the developer which is sufficiently stirred and charged to a development zone without being accompanied by a large-scaled apparatus.

33 Claims, 22 Drawing Sheets

PRIOR ART

DEVELOPING APPARATUS HAVING IMPROVED DEVELOPER DISTRIBUTION

DEVELOPING APPARATUS

This application is based on applications Nos. 9-280199, 9-287008, and 9-306928 filed in Japan, the contents of which are hereby incorporated by reference.

BACKGROUND OF THE INVENTION

1. Field of the Invention

The present invention relates to a developing apparatus, a cleaning apparatus and a developer transporting screw used therefor, which are used for an image forming apparatus of an electrophotographic type such as a copy machine and a printer. More specifically, the present invention relates to a developing apparatus for suppressing the movement of a developer in the midst of transportation between screws arranged vertically so that the developer may be stirred sufficiently to prevent the occurrence of fog on the image and the smoke of toner, a developer transporting screw therefor or a cleaning apparatus for suppressing the occurrence of the smoke of toner by using the developer transporting screw. The present invention further relates to a developing apparatus in which only the fully stirred and charged developer is transported into a development zone thereby obtaining an excellent image in a stable manner without occurrence of fog or unevenness.

2. Related Art

In the developing apparatus used for a copier or the like, when a developer in an insufficient stirred state or in a charge-short state is supplied to a development roller, the fog or unevenness of the image occurs.

Various devices have been made to solve the problem. One example is described in Japanese Unexamined Patent Publication No. Hei 5-333691. In this developing apparatus, upper and lower augers (screws) 82, 85 are arranged in such a manner that a barrier plate 84 is put therebetween in parallel in order to their transporting directions are opposed to each other, as shown in FIG. 29. A developer is supplied, while being circulated in a direction as indicated by the arrow, to a developer carrier (a development roller) 87 provided adjacent to the auger to develop an electrostatic latent image on a photosensitive medium through the developer carrier 87. In this developing apparatus, the upper auger 82 supplies developer to the developer carrier 87, and the lower auger 85 recovers developer from the developer carrier 87.

The barrier plate 84 is provided to prevent the movement of developer in the midst of transportation from the upper auger 82 to the lower auger 85 in the circulation of developer. The reason is that when the movement of developer between the augers in the midst of transportation occurs, the developer not sufficiently stirred is supplied to the developer carrier 87.

However, in the aforementioned conventional developing apparatus, since the upper auger 82 and the lower auger 85 have the same shape and rotate at similar rotational speed, pressure applied by the upper auger 82 to the lower auger 85 is the same as that of applied by the lower auger 85 to the upper auger 82. There occurs, what is called, the lowering of developer. That is, developer moves to the lower auger 85 in the midst of being transported by the upper auger 82 by gravity. When the lowering of developer occurs, toner newly supplied is supplied to the developer carrier (the development roller) 87 in the insufficient charged state without being sufficiently stirred by the upper auger 82. Therefore, the fog on the image and the smoke of toner may occur.

Further, since the barrier plate 84 is provided, the transfer of developer between the auger 82 and the auger 85 at opposite ends is impeded, and the developer may stay at the transfer portion of the developer. When developer stays at the portion, the developer is not well circulated and the deviation of developer transported by the augers 82 and 85 may occur. When the deviation of developer occurs in the auger 82, the developer is not evenly supplied from the auger 82 to the developer carrier 87, there arises the problem of the deterioration of image quality due to the unevenness or fog.

The augers are used also in the cleaning apparatus for removing developer which remains on the image carrier after transfer. However, when the conventional auger rotates, not only pressure in an axial direction of developer generates but also the outward pressure generates. Therefore, developer in the cleaning apparatus is released outward while being transported axially to generate the smoke of toner.

A further conventional developing apparatus is described in Japanese Examined Patent Publication No. Hei 4-9304. In this developing apparatus, shafts of a first auger (a transporting screw) 97 and a second auger 98 are projected from a development tank 92, and a mixing blade 91 is provided between the shafts to form a preliminary stirring chamber 93. Developer is sufficiently stirred by the blade 91 in the preliminary stirring chamber 93, charged and then supplied into the development tank 92.

However, there is a problem that the apparatus becomes larger in size. Because the preliminary stirring chamber 93 for sufficiently stirring developer to charge it is required this side of the development tank 92. Particularly, there arises a problem when the apparatus is used for a color image forming apparatus provided with a number of developing apparatuses.

SUMMARY OF THE INVENTION

The present invention has been accomplished in order to solve the aforementioned problem. It is therefore an object of the invention to provide a developing apparatus for suppressing occurrence of a lowering of developer to prevent occurrence of fog on the image and the smoke of toner.

It is a further object of the invention to provide a developing apparatus for preventing the movement of developer in the midst of transportation between developer transporting screws and then well performing the stirring and circulation of developer. A further object thereof is to provide a cleaning apparatus which prevents occurrence of the smoke of toner. A further object thereof is to provide a developer transporting screw for, without moving developer to other developer transporting screws in the midst of transportation, transporting only the developer present in the vicinity thereof.

It is still further object of the invention to provide a developing apparatus which, without being accompanied by large-scaled apparatus, can transport only the developer sufficiently stirred and charged into the development zone so that the developer is well circulated to obtain stably an excellent image without fog or unevenness.

The developing apparatus according to the present invention accomplished to solve the aforementioned problems includes a first screw for transporting developer in an axial direction, and a second screw arranged above the first screw and for transporting developer in an axial direction, in which a component in a normal direction of pressure generated by rotation of the first screw is larger than a component in a normal direction of pressure generated by rotation of the second screw.

In this developing apparatus, developer is transported by the first and second screws. Thereby, developer is stirred while being circulated. In the circulation of developer, a supply and recovery of developer to a development roller is carried out. Since the pressure in a normal direction generated by the first screw is higher than the pressure in a normal direction generated by the second screw, developer being transported by the second screw is not moved to the first screw in the midst of transportation. The lowering of developer does not occur. Accordingly, when toner is replenished, toner newly replenished is sufficiently stirred, and developer is supplied to the development roller. Thereby, fog on the image and the occurrence of the smoke of toner can be suppressed.

The developing apparatus according to a further embodiment of the present invention includes a development roller, a first screw for, while transporting developer in an axial direction, transporting the developer to the development roller, and a second screw arranged below the first screw and for recovering the developer from the development roller to transport it in an axial direction, and a third screw arranged above the first screw and for transporting developer in an axial direction, in which a component in a normal direction of pressure generated by rotation of the first screw is larger than a component in a normal direction of pressure generated by rotation of the second and third screws.

In this developing apparatus, three functions, i.e., the stirring of developer, the supply thereof to the development roller and the recovery thereof from the development roller, are shared by the third screw, the first screw, and the second screw. It is necessary to prevent the movement (lowering) of developer from the third screw to the first screw, occurring in the midst of transportation of developer by the respective screws, and the movement (raising) thereof from the second screw to the first screw. When the lowering occurs, developer is supplied to the development roller in the state where toner is not sufficiently stirred, and when the raising occurs, developer recovered is supplied to the development roller immediately. In any case, fog on the image and the smoke of toner occur. Thus, the first screw generates pressure in a normal direction higher as compared with the second and third screws so as not to generate the lowering of developer from the third screw to the first screw and the raising of developer from the second screw to the first screw. Accordingly, when toner is replenished, toner newly replenished is sufficiently stirred by the third screw, and developer is then supplied to the development roller. The recovered developer is not supplied to the development roller immediately. Thereby, occurrence of fog on the image and the smoke of toner can be suppressed.

In these developing apparatuses, means for making a component in a normal direction of pressure generated by rotation of the first screw the largest among that of other screws include as follows: (1) The rotational speed of the first screw is made the highest among that of other screws; (2) the pitch of the first screw is made the smallest among that of other screws; (3) the number of threads of the first screw is made the most among that of other screws, and (4) a paddle is provided on the first screw and no paddle is provided on other screws, or even if a paddle is provided on the other screws, an area thereof is made smaller than that of the paddle of the first screw. The paddle of the screws termed herein is a member for applying pressure only in a direction vertical to the transporting direction (a normal direction) without applying a transporting force (an axial pressure) to developer.

In the developer transporting screw according to another embodiment of the present invention, the screw is rotated about the axis to transport developer in an axial direction, and the screw is provided with radial means for applying a centripetal force by the inward pressure to developer.

Since the developer transporting screw has radial means in which the screw is rotated about the axis to thereby apply the inward pressure to developer, when the developer transporting screw rotates, the inward pressure is applied to developer. Developer present in the vicinity of the developer transporting screw is transported while being rolled into internal of the screw. Therefore, developer is not moved to the other developer transporting screw in the midst of transportation but only the developer present in the vicinity thereof can be transported without installing the barrier plate between the other developer transporting screw. At the portion where developer is received from the other developer transporting screw, developer in the other developer transporting screw is sucked by the inward pressure generated by rotation of the other developer transporting screw. Therefore, developer can be delivered smoothly without staying.

In the case where the developer transporting screw is applied to the developing apparatus, in one developer transporting screw, radial means may be provided at the portion in which developer is delivered from the other developer transporting screw. In this way, developer present in the other developer transporting screw can be sucked at that portion. Developer can be delivered smoothly without staying. Accordingly, since the stirring and circulation of developer is well performed, no deviation occurs in developer. The deterioration of image quality caused by unevenness and fog can be also prevented.

Preferably, in one developer transporting screw, radial means may be provided at the portion in which developer is recovered from the development roller. In this way, developer on the development roller can be sucked at that portion. Therefore, developer can be recovered from the development roller smoothly.

The developer transporting screw can be also applied to a cleaning apparatus having a cleaning member for recovering developer remained on an image carrier after transfer and a developer storage tank for storing developer recovered. In this case, the developer transporting screw performs the transportation of developer recovered by the cleaning member to the developer storage tank. In the cleaning apparatus, developer present in the vicinity of the developer transporting screw is transported while being rolled into internal of the screw by the inward pressure generated by the radial means. This prevents occurrence of the smoke of toner within the cleaning apparatus.

The radial means for applying the inward pressure to developer by rotation of the developer transporting screw includes, for example, a blade member in which the front surface of the direction moved by rotation of the developer transporting screw is directed inward. An example of a specific shape of "a blade member in which the front surface of direction moved by rotation of the developer transporting screw is directed inward" is a shape curved so as to depict a continuous smooth curve from the rotational center of the developer transporting screw toward the outside, as shown in FIG. 13.

Further, the developer transporting screw according to another embodiment of the present invention has a configuration in which the screw is rotated about an axis to thereby transport developer in an axial direction, and comprises centrifugal means for applying the outward pressure to developer.

Since this developer transporting screw has centrifugal means in which the screw is rotated about an axis to thereby apply the outward pressure to developer, when the developer transporting screw is rotated, the outward pressure is applied to developer. Also in the conventional developer transporting screw, the outward pressure is applied to developer by rotation thereof, but its pressure is very low as compared with the pressure generated by the developer transporting screw of the present invention. The high outward pressure prevents the movement of developer from the other developer transporting screw adjacent thereto, and the developer transporting screw transports only the developer present in the vicinity thereof. Therefore, the developer transporting screw can transport only the developer in the vicinity without rolling developer from the other developer transporting screw in the midst of transportation. At the portion for delivery of developer, developer is moved to the other developer transporting screw by high outward pressure generated by rotation of the developer transporting screw. Therefore, developer can be delivered smoothly without staying.

In the case where the developer transporting screw is applied to the developing apparatus, in one developer transporting screw, centrifugal means may be provided at the portion in which developer is delivered to the other developer transporting screw. In this way, developer is released to the other developer transporting screw at that portion. Therefore, developer can be delivered smoothly without staying. Accordingly, since the stirring and circulation of developer is well performed, no deviation occurs in developer. Thereby, the deterioration of image quality caused by unevenness and fog can be also prevented.

Preferably, in one developer transporting screw of the developing apparatus, centrifugal means may be provided at the portion in which developer is supplied to the development roller. The developer can be released toward the development roller at that portion. Therefore, the supply of developer to the development roller can be performed smoothly.

The centrifugal means for applying the outward pressure to developer by rotation of the developer transporting screw includes, for example, a blade member in which the front surface of direction moved by rotation of the developer transporting screw is directed outward. An example of a specific shape of "a blade member in which the front surface of direction moved by rotation is directed outward" is a shape curved so as to depict a continuous smooth curve from the rotational center of the developer transporting screw toward the outside, as shown in FIG. 15.

The developing apparatus according to another embodiment of the present invention comprises a developer storage tank, a plurality of transporting screws for transporting developer in an axial direction within the developer storage tank, and a preliminary stirring means for stirring developer, the preliminary stirring means including a cylindrical body provided within the developer storage tank, an internal screw provided inside the cylindrical body and rotatable about an axis, and an external screw provided outside the cylindrical body and rotatable about an axis. The transporting direction of developer by the internal screw and the transporting direction of developer by the external screw are reversed to each other.

In this developing apparatus, developer within the cylindrical body is transported by the internal screw provided within the cylindrical body. On the other hand, developer outside the cylindrical body is transported by the external screw provided outside the cylindrical body. At this time, since the transporting direction of developer by the internal screw and the transporting direction of developer by the external screw are reversed to each other, a new circulation route of developer is formed in the preliminary stirring means. As described, a new circulation route of developer is formed in the preliminary stirring means, and developer is sufficiently stirred and charged while developer is transported in the circulation route. Thereafter, developer is transported by a plurality of transporting screws, circulated within the developer storage tank and supplied to the developer carrier. Thereby, since only the sufficiently stirred developer is supplied to the developer carrier, an excellent image can be obtained stably without occurrence of fog or unevenness. Further, since the preliminary stirring means is installed within the developer storage tank, a preliminary stirring chamber need not be installed this side of the developer storage tank to provide a compact developing apparatus.

The preliminary stirring means is arranged on the extension of one of the transporting screws, and it is desired that the transporting direction of the internal screw be coincided with the transporting direction of the transporting screw.

In this case, since the transporting direction of the internal screw and the transporting direction of the transporting screw are in the same direction, developer is smoothly supplied from the preliminary stirring means to the transporting screw. Thereby, the developer in the developer storage tank can be sufficiently circulated. Accordingly, an excellent image can be obtained stably without occurrence of fog or unevenness. It is desired that the preliminary stirring means be arranged on upstream extension of the developer transporting direction for the transporting screw, so that developer can be supplied after it has been sufficiently stirred.

Preferably, the cylindrical body has a passage hole through which internal and external developers can pass, one end of the cylindrical body is positioned within the development zone, and the other end of the cylindrical body and the passage hole are positioned outside the development zone.

In this way, since the passage hole provided in the cylindrical body is arranged outside the development zone, the circulation route of developer in the preliminary stirring means is formed outside the development zone. That is, since developer is sufficiently stirred by the preliminary stirring means before it is supplied to the development zone, there is less possibility that developer insufficiently stirred and charged is supplied into the development zone. Further, since developer being transported inside the cylindrical body of the preliminary stirring means is transported being held on the inner wall thereof, developer is not moved to the other transporting screw at the portion where the cylindrical body is present. Therefore, the developer is sufficiently stirred and charged. Since one end of the cylindrical body (the side in which developer is supplied to the transporting screw) is arranged so as to be positioned within the development zone, even if developer is supplied to the transporting screw without circulating the circulation route formed by the preliminary stirring means, developer is stirred while being transported within the cylindrical body. Thereby, the developer insufficiently stirred or charged sure will be extinct and never be supplied. Accordingly, an excellent image can be obtained stably without occurrence of fog or unevenness. The passage hole may be only for outflow. Preferably, the passage holes for both inflow and outflow may be provided.

The outside of the development zone termed herein is a zone in which a developer carrier is not present in the vertical direction of the developer storage tank. On the other hand, the inside of the development zone termed herein is a zone in which a developer carrier is present in the vertical direction of the developer storage tank.

The developing apparatus according to the present invention has a great significance when it is applied to a vertical type developing apparatus having a plurality of transporting screws arranged vertically. That is, it does not need a barrier plate for preventing the developer movement, which occurs in the midst of transportation between the transporting screws arranged vertically.

Preferably, the developer storage tank is formed with a replenishing port for replenishing developer so that developer replenished from the replenishing port flows into the cylindrical body.

In the case of developer of a two-component system consisting of toner and carrier, the toner is consumed by development and reduced. Therefore, toner should be replenished so that toner density of developer (ratio of toner to the entire developer) is maintained within a proper range. However, when toner newly replenished is supplied into the development zone without being sufficiently stirred with developer, image quality deteriorates due to unevenness or fog. Accordingly, toner newly supplied is required to be sufficiently stirred with developer before being supplied into the development zone.

The developer storage tank is provided with a replenishing port for replenishing developer so that toner replenished flows into the cylindrical body of the preliminary stirring means. More specifically, the replenishing port may be provided at a position facing to the outside of the cylindrical body and the outside of the development zone. More preferably, the port may be provided at a position directly above an in-flow passage hole provided in the cylindrical body. Thereby, toner replenished is transported by the internal screw which is arranged inside the cylindrical body. A part of developer being transported by the internal screw is supplied to the transporting screw, while other toner is released outside the cylindrical body from the out-flow passage hole. Toner released out of the passage hole is transported in a direction reversed to the transporting direction of the internal screw by the external screw which is arranged outside the cylindrical body. As described above, toner is sufficiently stirred and mixed with developer, and charged while it is transported along the circulation route formed by the preliminary stirring means. Accordingly, since toner short in charge is prevented from being supplied into the development zone, an excellent image can be obtained stably without occurrence of fog or unevenness.

DETAILED DESCRIPTION OF THE PREFERRED EMBODIMENTS

[First Embodiment]

The first embodiment provides, in an image forming apparatus of an electrophotographic type, a developing apparatus used to develop an electrostatic latent image formed on a photosensitive drum.

Figure 1:
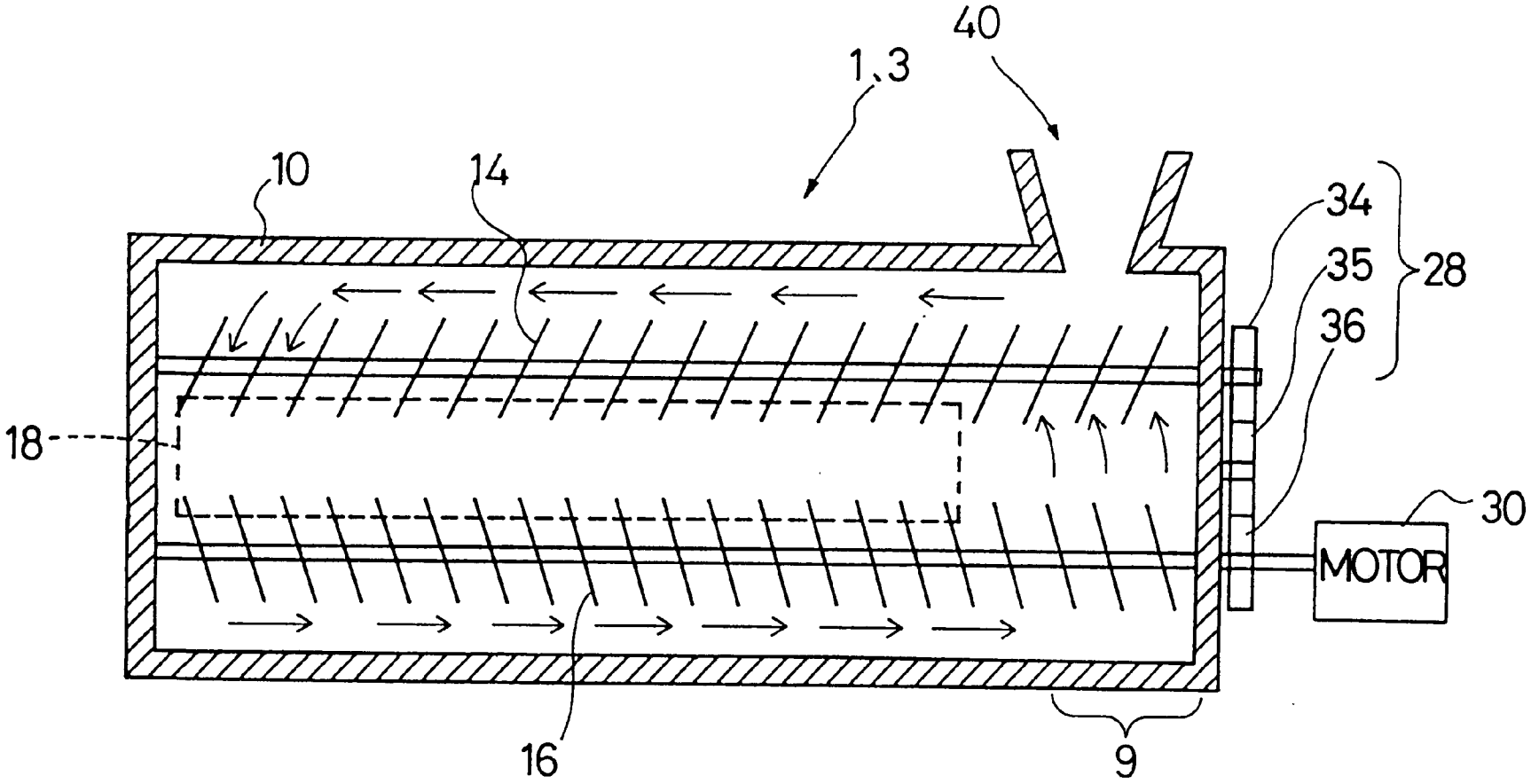
FIG. 1 is a sectional front view showing the structure of a developing apparatus according to the first embodiment.

In a developing apparatus 1 according to the first embodiment, two screws, i.e., a supply screw 14 and a recovery screw 16 are provided in parallel with each other within a developer storage tank 10 for storing developer, as shown in FIG. 1. In any of these, a number of screw blades are provided diagonally on the rotatable shaft. However, the diagonal directions of the respective screw blades are reversed to one another. The shafts of the supply screw 14 and the recovery screw 16 are connected by a train of gears 28 outside the developer storage tank 10. Further, the shaft of the recovery screw 16 is provided with a motor 30 controlled on the main body of the image forming apparatus. In the train of gears 28, a gear 36 of the recovery screw 16 has more teeth than that of a gear 34 of the supply screw 14. An intermediate gear 35 is provided between the gear 36 and the gear 34. When the motor 30 is rotated, the supply screw 14 and the recovery screw 16 are rotated in the same direction, and the recovery screw 16 is rotated faster than the supply screw 14. A toner replenishing port 40 is provided upstream the supply screw 14 (the right-hand side in FIG. 1), from which toner is replenished into the developer storage tank 10.

Figure 2:
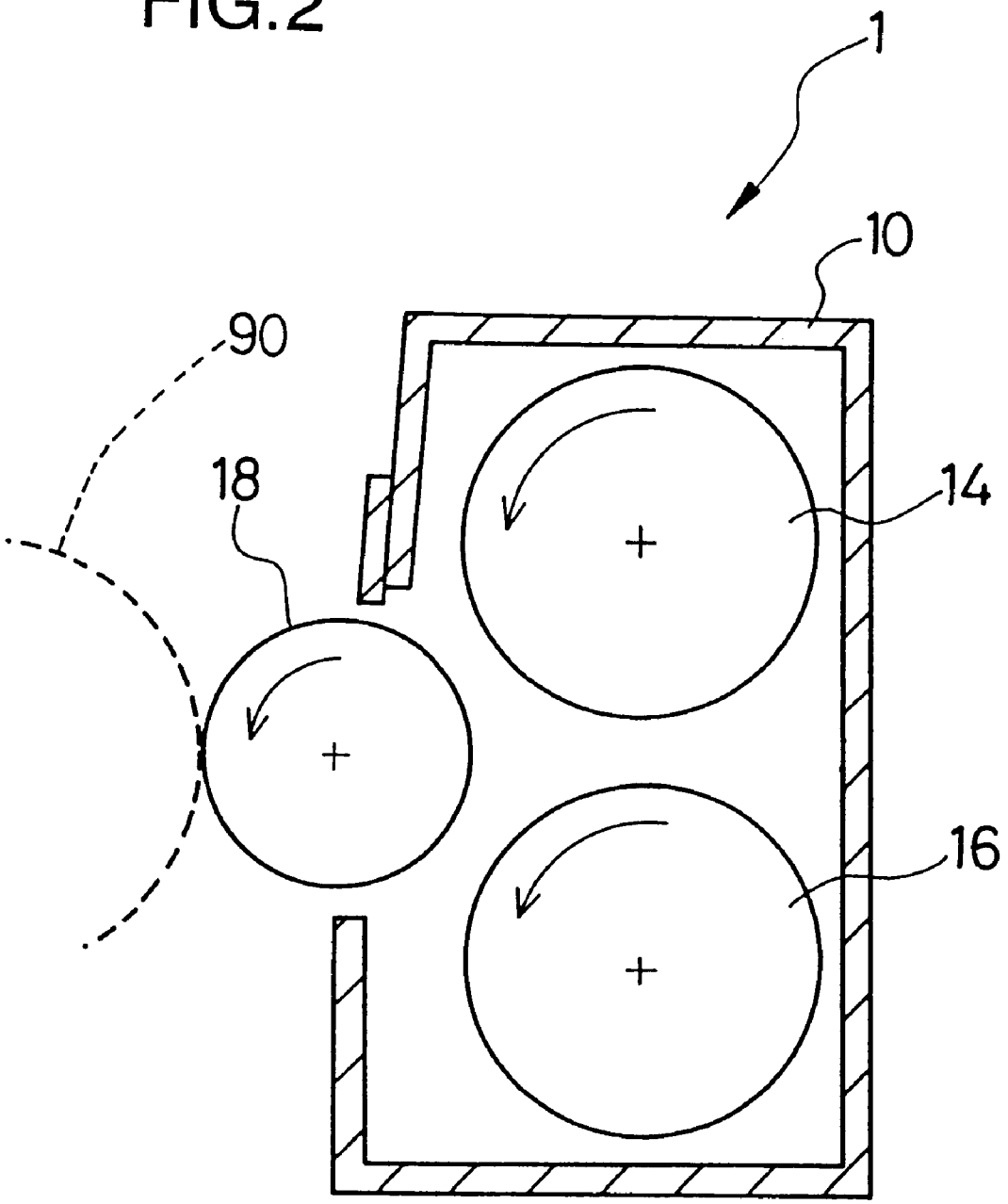
FIG. 2 is a sectional side view of the developing apparatus according to FIG. 1.

These two screws are arranged vertically as shown in a sectional side view of FIG. 2. That is, the supply screw 14 and the recovery screw 16 are positioned on the upper stage and the lower stage, respectively. A development roller 18 is provided, at a height between the supply screw 14 and the recovery screw 16, with a part thereof projected from the developer storage tank 10. The development roller 18 is positioned in proximity to a photosensitive drum 90 of the image forming apparatus so that toner is imparted to an electrostatic latent image of the photosensitive drum 90 to develop it.

The operation of the developing apparatus 1 will be explained. When the motor 30 is rotated by control from the main body of the image forming apparatus, the recovery screw 16 in coaxial with the motor 30 rotates. Its rotation is also transmitted to the supply screw 14 through the train of gears 28. Therefore, the supply screw 14 also rotates in the same direction as the recovery screw 16 at a lower speed than the recovery screw 16.

The transporting force with respect to developer in the developer storage tank 10 is generated by the rotation of the supply screw 14 and the recovery screw 16. However, since the supply screw 14 and the recovery screw 16 are reversed to each other in the diagonal direction of the screw blades, the transporting direction in the upper and lower stages of developer is reversed to each other. In FIG. 1, developer is transported leftward by the upper supply screw 14, and is transported rightward by the lower recovery screw 16. Developer transported by the supply screw 14 reaches the left-side end, and then falls and shifts to the lower recovery screw 16. Developer transported by the recovery screw 16 reaches the right-side end, and then overflows upward and shifts to the supply screw 14. In this way, the developer circulates counterclockwise in the developer storage tank 10. The portion at the right end of the developer storage tank 10 in which developer is delivered from the recovery screw 16 to the supply screw 14 is referred to as a drawing portion 9.

As developer circulates, a part of developer in the upper supply screw 14 is supplied to the development roller 18. Thereby, the development roller 18 is allowed to develop for imparting toner to the electrostatic latent image on the photosensitive drum 90. Extra developer on the development roller 18 is recovered by the lower recovery screw 16.

In the circulation of developer, since the recovery screw 16 rotates at higher speed than the supply screw 14, the normal direction component of pressure generated by the rotation of the recovery screw 16 is larger than that of the supply screw 14. Accordingly, developer stirred while being transported by the supply screw 14 is not moved to the recovery screw 16 in the midst of transportation. Therefore, the lowering of developer does not occur. The developer is sufficiently stirred while the toner is transported from the toner replenishing port 40 to the development roller 18. Thereby, developer with sufficiently stirred and the toner uniformly dispersed is supplied to the development roller 18.

As described in detail above, in the first embodiment, there is provided a developing apparatus for performing the supply and recovery of developer to/from the development roller while circulating developer by the supply screw 14 at the upper stage and the recovery screw 16 at the lower stage. The recovery screw 16 rotates at higher speed than the supply screw 14 to generate higher pressure in the normal direction. Therefore, the lowering of developer is prevented. That is, the invention solves the problem that developer being transported by the supply screw 14 is moved to the recovery screw 16 in the midst of transportation. Thereby, toner replenished from the toner replenishing port 40 is sufficiently stirred, before the developer is supplied to the development roller 18. Accordingly, occurrence of fog on the image or the smoke of toner can be suppressed.

The present embodiment is an example and does not limit the present invention in any respect. Accordingly, the present invention can be variously improved and changed within the scope not departing from the subject matter thereof. For example, the inclined directions of the screw blades 14 and 16 may be arranged in the same direction. In the case, the train of gears 28 is changed so as to reverse the rotational direction.

[Second Embodiment]

The second embodiment will be explained. In the developing apparatus according to the second embodiment, a difference in pitch between the upper and lower screws is provided, instead of a difference in rotational speed between the supply screw 14 and the recovery screw 16. Thereby, the component in a normal direction of pressure generated by the recovery screw 16 further increases.

Figure 3:
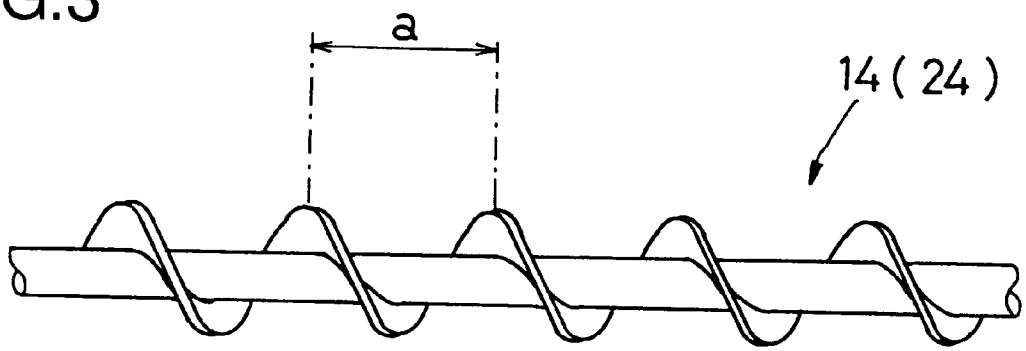
FIG. 3 shows a screw blade of a supply screw for a developing apparatus according to the second embodiment and that of a stirring screw for a developing apparatus according to the fifth embodiment.
Figure 4:
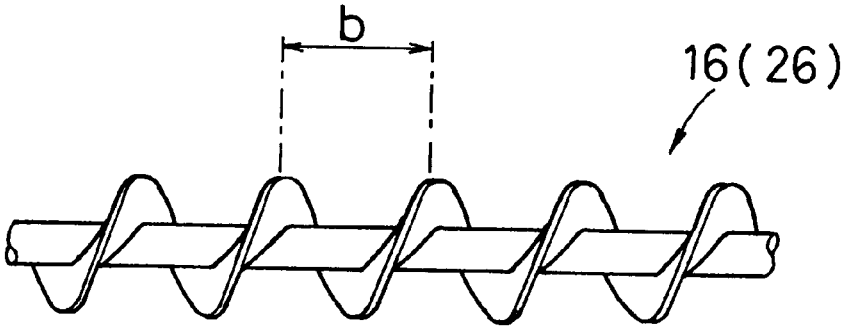
FIG. 4 shows a screw blade of a recovery screw for a developing apparatus according to the second embodiment and that of a supply screw for a developing apparatus according to the fifth embodiment.

In the developing apparatus according to the second embodiment, the pitch b of the recovery screw 16 shown in FIG. 4 is smaller than the pitch a of the supply screw 14 shown in FIG. 3. "The pitch of the screw is small" means that the inclination degree of the screw blade to the shaft is small (the screw blade and the shaft become closer to vertical) whereby the spacing between the screw blades adjacent to each other is made small. On the other hand, "The pitch of the screw is large" means that the inclination degree of the screw blade to the shaft is large (the screw blade and the shaft become closer to parallel) whereby the spacing between the screw blades adjacent to each other is made large. When the pitch of the screw is small, the distance of developer being transported in an axial direction during one rotation of the screw is shortened. Therefore, pressure generated by rotation of the screw is low in the axial component and is high in the normal component.

On the other hand, the train of gears of the developing apparatus is made so that the supply screw 14 and the recovery screw 16 are the same in rotational speed. The others are not particularly changed from the case of the first embodiment.

In such a developing apparatus as described, since the pitch of the recovery screw 16 is smaller than that of the supply screw 14, the recovery screw 16 is larger in the component in a normal direction of pressure generated by rotation of the screw. Accordingly, developer being stirred while being transported by the supply screw is not moved to the recovery screw 16 in the midst of transportation, and the lowering of developer does not occur. Therefore, developer is sufficiently stirred while the toner is transported from the toner replenishment port 40 to the development roller 18. Thereby, developer with toner sufficiently stirred and dispersed uniformly is supplied to the development roller 18. Thereby, the occurrence of fog on the image or the smoke of toner can be suppressed.

[Third Embodiment]

The third embodiment will be explained. In the developing apparatus according to the third embodiment, a difference in the number of threads between the upper and lower screws is provided, instead of a difference in rotational speed between the supply screw 14 and the recovery screw 16. Thereby, the component in a normal direction of pressure generated by the recovery screw 16 further increases.

Figure 5:
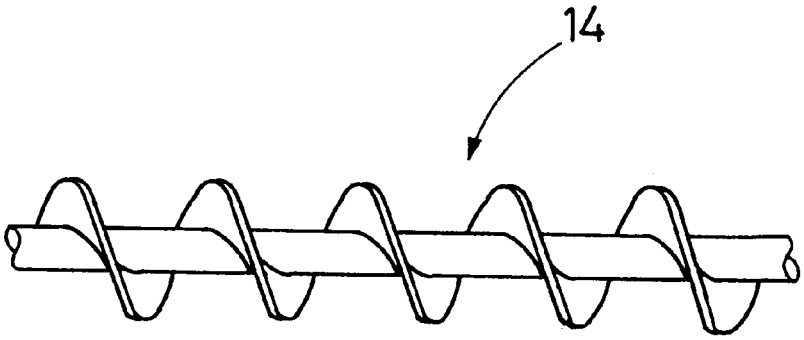
FIG. 5 shows a screw blade of a supply screw for a developing apparatus according to the third embodiment.
Figure 6:
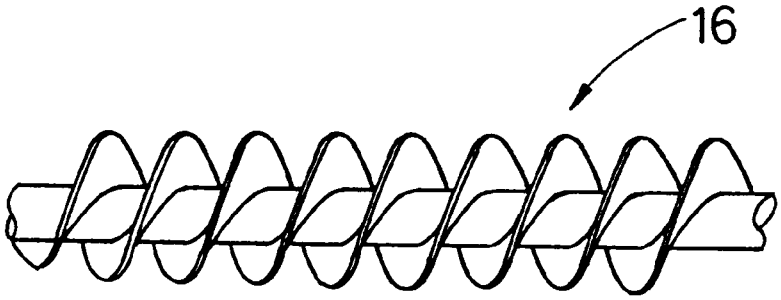
FIG. 6 shows a screw blade of a recovery screw for a developing apparatus according to the third embodiment.

In the developing apparatus according to the third embodiment, the number of threads for the recovery screw 16 is two as shown in FIG. 6. On the other hand, the number of threads for the supply screw 14 is one as shown in FIG. 5. As the number of threads increases, developer receives force by more screw blades and pressure applied to a unit of area becomes larger.

On the other hand, similar to the second embodiment, the train of gears of the developing apparatus is made so that the supply screw 14 and the recovery screw 16 are the same in rotational speed. Others parts are not particularly changed from the case of the first embodiment.

In such a developing apparatus as described, since the number of threads for the recovery screw 16 is larger than the number of threads for the supply screw 14, the component in normal direction of pressure generated by rotation of the recovery screw 16 is larger. Accordingly, developer being stirred while being transported by the supply screw 14 is not moved to the recovery screw 16 in the midst of transportation. Thereby the lowering of developer does not occur. Therefore, developer is sufficiently stirred while the toner is transported from the toner replenishment port 40 to the development roller 18. Thereby, developer in a state that toner is sufficiently stirred and dispersed uniformly thereof is supplied to the development roller 18. Thereby, the occurrence of fog on the image or the smoke of toner can be suppressed.

[Fourth Embodiment]

The fourth embodiment will be explained. In the developing apparatus according to the fourth embodiment, paddles are provided on the recovery screw 16, instead of a difference in rotational speed between the supply screw 14 and the recovery screw 16. Thereby, the component in a normal direction of pressure generated by the recovery screw 16 further increases.

Figure 7:
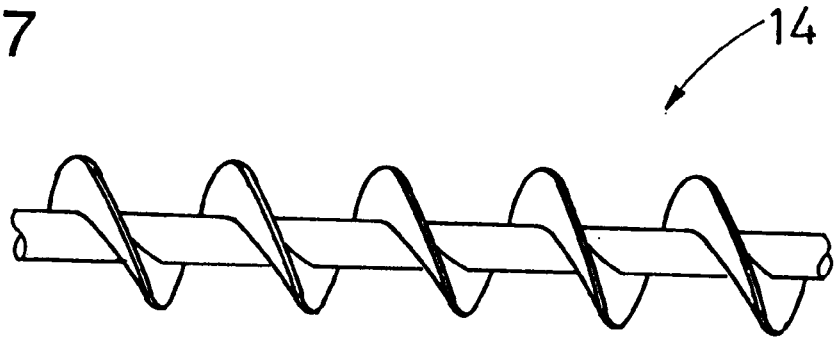
FIG. 7 shows a screw blade of a supply screw for a developing apparatus according to the fourth embodiment.
Figure 8:
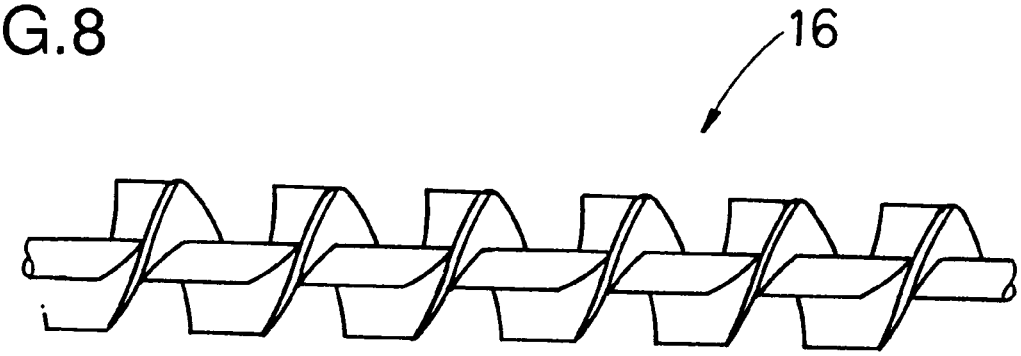
FIG. 8 shows a screw blade of a recovery screw for a developing apparatus according to the fourth embodiment.
Figure 9:
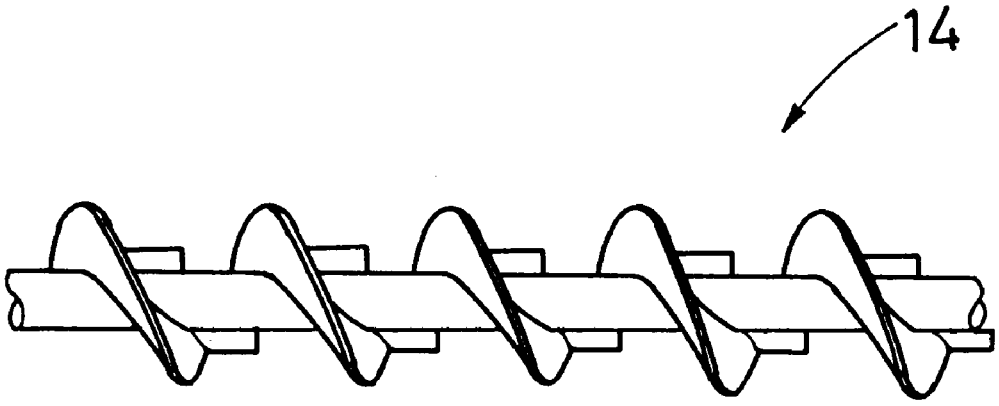
FIG. 9 shows a screw blade of a screw which can be used as a supply screw for a developing apparatus according to the fourth embodiment.

In the developing apparatus according to the fourth embodiment, the recovery screw 16 applies a screw blade with paddles as shown in FIG. 8. On the other hand, the supply screw 14 applies screw blade without paddles as shown in FIG. 7. As shown in FIG. 9, the supply screw 14 may apply screw blade with paddles as long as area of the paddle is smaller than area of paddle for the recovery screw 16.

On the other hand, similar to the second and third embodiments, a train of gears of the developing apparatus is made so that the supply screw 14 and the recovery screw 16 rotate at the same speed. Others parts are not particularly different from the aforementioned respective embodiments embodiment.

In such a developing apparatus as described, since the recovery screw 16 applies a screw blade with paddles, the recovery screw 16 is larger in the component in normal direction of pressure generated by rotation of the screw. Accordingly, developer being stirred while being transported by the supply screw 14 is not moved to the recovery screw 16 in the midst of transportation. Thereby, the lowering of developer does not occur. Therefore, developer is sufficiently stirred while the toner is transported from the toner replenishment port 40 to the development roller 18. Thereby, developer in a state that toner is sufficiently stirred and dispersed uniformly thereof is supplied to the development roller 18. Thereby, the occurrence of fog on the image or the smoke of toner can be suppressed.

[Fifth Embodiment]

Figure 10:
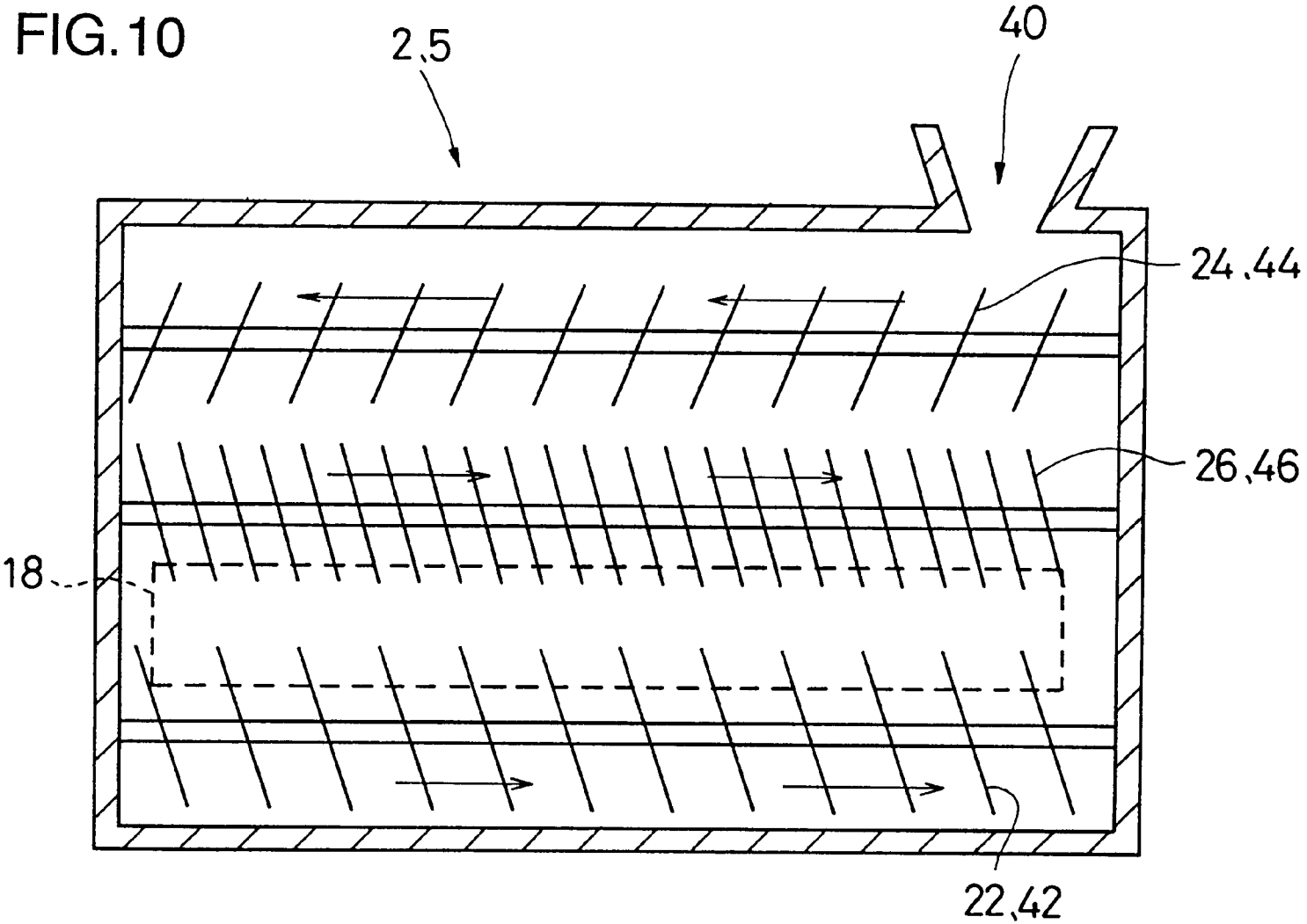
FIG. 10 is a sectional front view of a developing apparatus according to the fifth embodiment.
Figure 11:
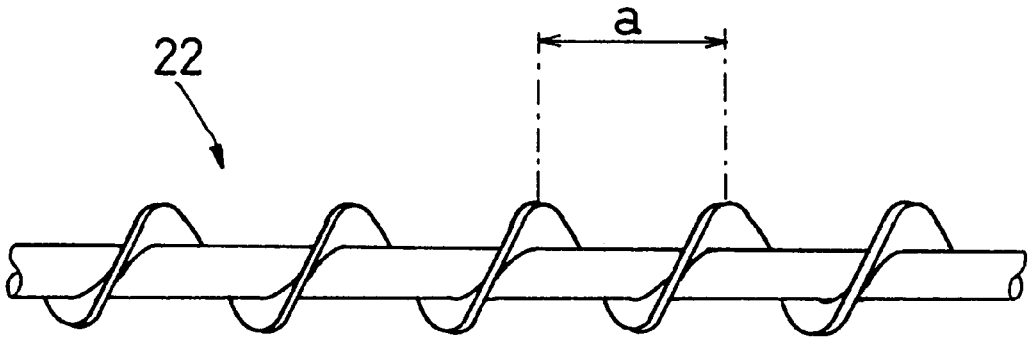
FIG. 11 shows a screw blade of a recovery screw for a developing apparatus according to the fifth embodiment.

The fifth embodiment will be explained. In the developing apparatus 2 according to the fifth embodiment, three screws, i.e., a supply screw 26, a recovery screw 22 and a stirring screw 24 are provided in parallel with one another as shown in FIG. 10. The supply screw 26 is the same as the recovery screw 16 according to the second embodiment (FIG. 4). The stirring screw 24 is the same as the supply screw 14 according to the second embodiment (FIG. 3). The recovery screw 22 is the screw which is oppositely inclined to the screw blade of the supply screw 14 according to the second embodiment (FIG. 11).

These three screws are arranged vertically. That is, the stirring screw 24, the recovery screw 22, and the supply screw 26 are positioned at the uppermost, lowermost, and middle stages, respectively. The screws receive the rotational driving from the outside of the tank by the control from the main body of the image forming apparatus. The transporting directions of developer by each screw is in such a manner that the supply screw 26 and the recovery screw 22 are directed rightward in the figure, and the stirring screw 24 are directed leftward in the figure.

The pitch b of the supply screw 26 is smaller than the pitch a of the stirring screw 24 and the recovery screw 22. Thereby, the component in a normal direction of pressure generated by the supply screw 26 is the largest. In the present embodiment, the stirring screw 24 and the recovery screw 22 are the same in pitch. However, these pitches may be different as long as they are larger than the pitch b of the supply screw 26.

In the developing apparatus 2, the component in a normal direction of pressure generated by the supply screw 26 is larger than that generated by the stirring screw 24 and the recovery screw 22. Therefore, developer is not moved between the screws in the midst of transportation similar to the case of the aforementioned respective embodiments. Accordingly, since developer being stirred by the stirring screw 24 is not moved to the supply screw 26 in the midst of transportation, the lowering of developer does not occur. Further, since developer being transported by the recovery screw 22 is not moved to the supply screw 26 in the midst of transportation, the raising of developer does not occur neither. Therefore, developer is sufficiently stirred while the toner is transported from the toner replenishment port 40 to the development roller 18. Further, since developer recovered by the recovery screw 22 is not moved to the supply screw 26, developer is not supplied to the development roller 18 immediately.

According to the fifth embodiment, the supply screw 26 generates higher in the normal direction component of pressure than that of the stirring screw 24 and the recovery screw 22. Therefore, the lowering of developer, that is, the developer being transported by the stirring screw 24 moves to the supply screw 26 in the midst of transportation, is prevented. The raising of developer, that is, the developer being transported by the recovery screw 22 moves to the supply screw 26 in the midst of transportation, is also prevented. Thereby, after toner replenished from the toner replenishing port 40 has been sufficiently stirred, the developer is supplied to the development roller 18. On the other hand, developer recovered by the recovery screw 22 is not supplied to the development roller 18 immediately. In this manner, the occurrence of fog on the image and the smoke of toner can be suppressed.

The present embodiment is an example and does not limit the present invention in any respect. Accordingly, the present invention can be variously improved and changed within the scope not departing from the subject matter thereof. For example, so as to make a difference in a component in normal direction of pressure among the supply screw 26, the stirring screw 24, and recovery screw 24, any cases described in the first through fourth embodiments may be employed and it is not limited to a difference in pitch of a screw. Further, between the supply screw 26 and the stirring screw 24 or between the supply screw 26 and the recovery screw 22, each couple of screws may employ different means described in those embodiments.

[Sixth Embodiment]

Figure 12:
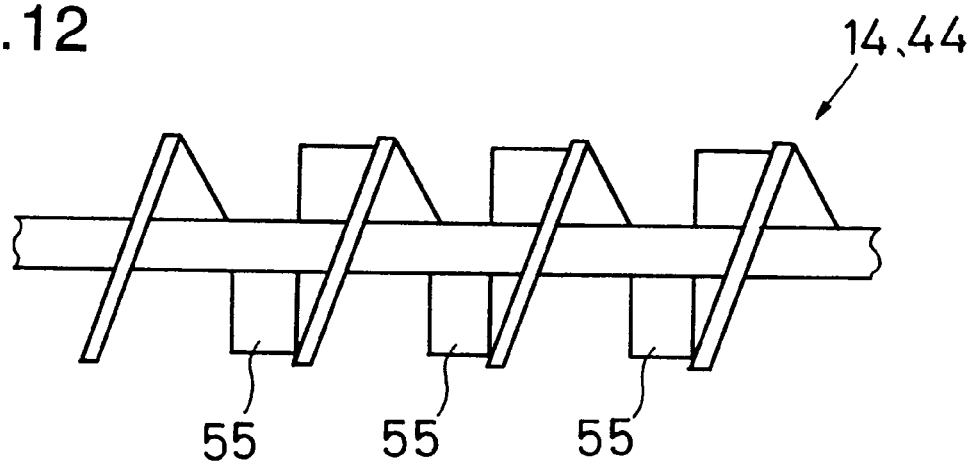
FIG. 12 shows a screw blade of a supply screw for a developing apparatus according to the sixth embodiment, that of a stirring screw for a developing apparatus according to the eighth embodiment, and that of a transporting screw for a cleaning apparatus according to the ninth embodiment.
Figure 13:
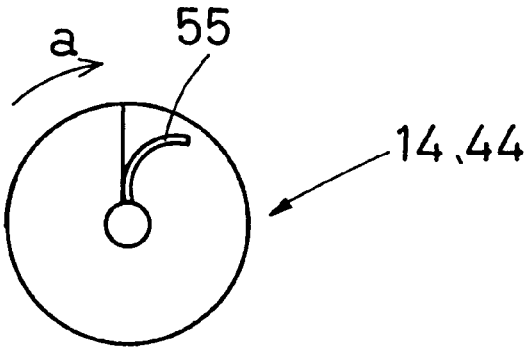
FIG. 13 is a sectional side view of the screw shown in FIG. 12.
Figure 14:
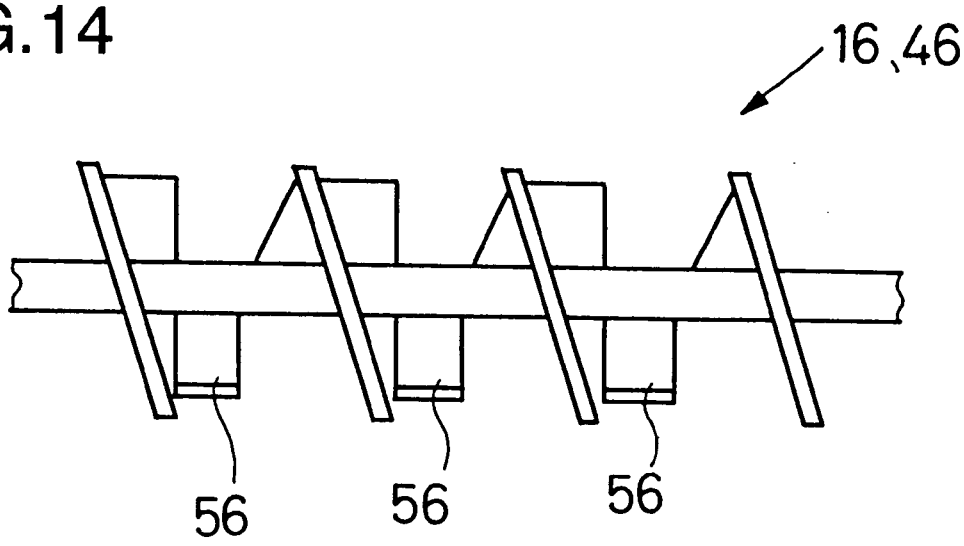
FIG. 14 shows a screw blade of a recovery screw for a developing apparatus according to the sixth embodiment and that of a supply screw for a developing apparatus according to the eighth embodiment.
Figure 15:
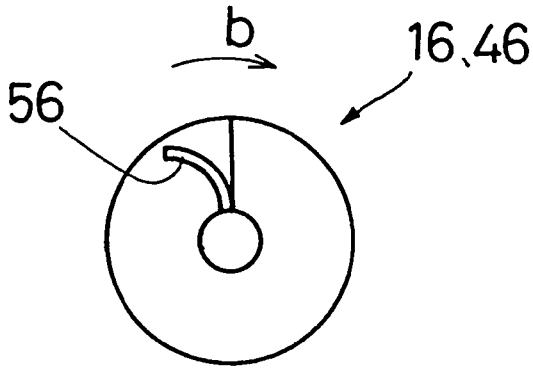
FIG. 15 is a sectional side view of the screw shown in FIG. 14.

A developing apparatus 3 according to the sixth embodiment has almost the same entire structure as a developing apparatus 1 according to the first embodiment (FIG. 1). However, as shown in FIG. 12, a supply screw 14 is provided with a radial member 55 to apply inward pressure to developer. As shown in FIG. 13, the radial member 55 is a blade member which has a shape curved from rotational center of the screw toward outside so that front surface of the direction a moved by rotation of the screw is inward. As shown in FIG. 14, a recovery screw 16 is provided with a centrifugal member 56 to apply outward pressure to developer. As shown in FIG. 15, the centrifugal member 56 is a blade member which has a shape curved from rotational center of the screw toward outside so that front surface of the direction b moved by rotation of the screw is outward.

In the developing apparatus 3 according to the present embodiment, since the supply screw 14 has the radial member 55, the screw is rotated about the axis to thereby apply inward pressure to developer when a motor 30 rotates to circulate developer in a developer storage tank 10. The supply screw 14 transports developer present in the vicinity thereof rolling the developer internally of the screw with the inward pressure. On the other hand, since the recovery screw 16 has the centrifugal member 56, the screw is rotated about the axis to thereby apply outward pressure to developer. Developer is prevented from moving from the supply screw 14 by the outward pressure and the recovery screw 16 transports only the developer present in the vicinity thereof.

Accordingly, the developer being transported is not moved between the supply screw 14 and the recovery screw 16 in the midst of transportation. Therefore, toner replenished from the toner replenishing port 40 is sufficiently stirred and dispersed uniformly before supplied to the development roller 18. Thereby, only the developer in a state that toner is sufficiently stirred and dispersed uniformly is supplied to the development roller 18. Further, since the developer recovered by the recovery screw 16 is not moved to the supply screw 14, the developer is not directly supplied to the development roller 18.

At the drawing portion 9, the developer transported from the recovery screw 16 to the right end portion is pushed upward by the outward pressure which the rotation of the recovery screw 16 generates. Then, the developer pushed upward is sucked by inward the pressure which the rotation of the supply screw 14 generates. Accordingly, developer is smoothly delivered without staying.

As described, according to the sixth embodiment, the radial member 55 is provided to generate inward pressure when the supply screw 14 rotates and the centrifugal member 56 is provided to generate outward pressure when the recovery screw rotates. Thereby, without a barrier plate between the supply screw 14 and the recovery screw 16, developer is prevented from moving to the recovery screw 16 from the supply screw 14. Further, developer is supplied to the development roller 18 after the toner replenished from the toner replenishing port 40 is sufficiently stirred. Also, developer recovered by the recovery screw 16 is not directly supplied to the development roller 18.

Moreover, since developer is smoothly delivered at the drawing portion 9, deviation of developer does not occur. Thereby, deterioration of image quality caused by unevenness and fog of toner is prevented.

The developing apparatus 3 employs both the supply screw 14 with the radial member 55 and the recovery screw 16 with the centrifugal member 56. However, to some extent, same effect is obtained when either of the screws and a normal screw are combined and used therein. Not to mention, the aforementioned screws are applicable to a developing apparatus in which a developer transporting screw is arranged vertically as well as to a developing apparatus in which screws are arranged horizontally.

Figure 16:
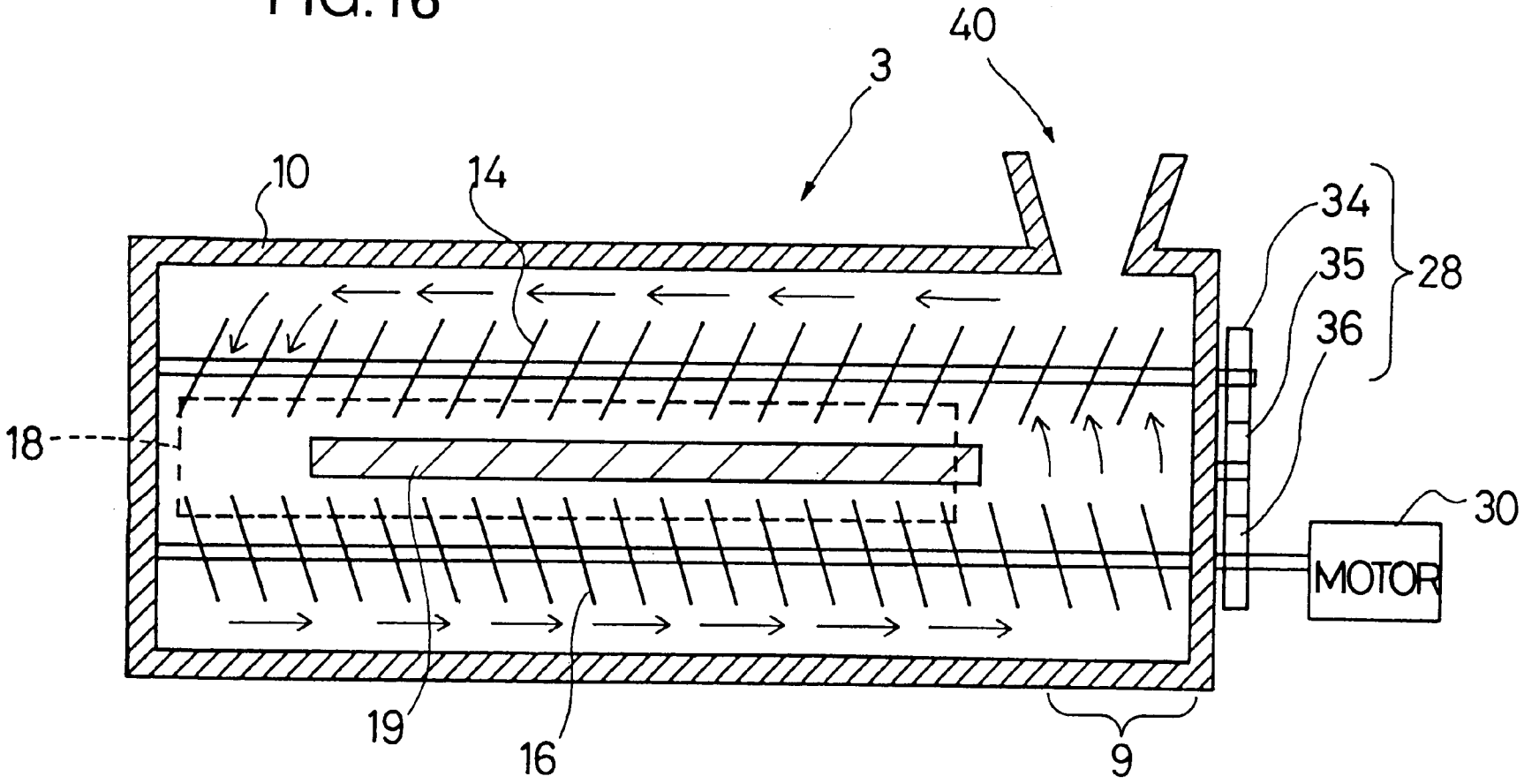
FIG. 16 is a sectional front view showing the structure of a developing apparatus in which a barrier plate is provided.

Further, although the aforementioned developing apparatus 3 does not have a barrier plate between the supply screw 14 and the recovery screw 16, the barrier plate 19 may be applied to a zone where supply and recovery of the developer for the development roller 18 is performed as shown in FIG. 16. In such a case, it is sufficient for the supply screw 14 and recovery screw 16 to have the radial member 55 and the centrifugal member 56, respectively, at the adjacent area to the drawing portion 9 where developer is drawn to the supply screw 14 from the recovery screw 16. Thereby, even if a barrier plate is present between the supply screw 14 and the recovery screw 16, developer is smoothly delivered and therefore deviation of developer does not occur.

[Seventh Embodiment]

Figure 17:
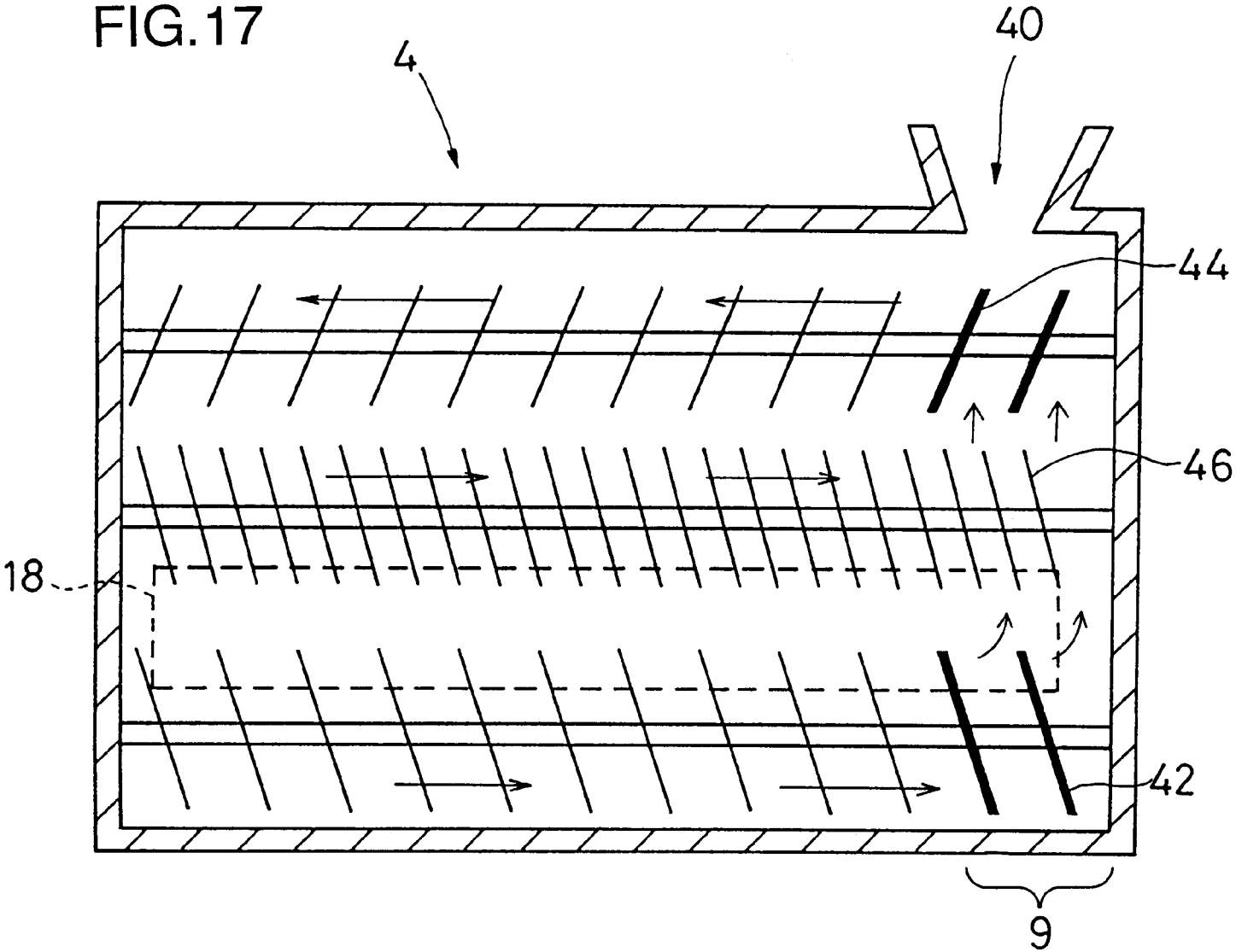
FIG. 17 is a sectional front view showing structure of a developing apparatus according to the seventh embodiment.

The seventh embodiment will be explained. In a developing apparatus 4 according to the seventh embodiment, three screws, i.e., a supply screw 46, a recovery screw 42 and a stirring screw 44 are provided in parallel with one another as shown in FIG. 17. These three screws are arranged vertically. That is, the stirring screw 44, the recovery screw 42, and the supply screw 46 are positioned at the uppermost, lowermost, and middle stages, respectively. Further, a radial member 55 of FIG. 13 is provided on a drawing portion 9 of the stirring screw 44. A centrifugal member 56 of FIG. 15 is provided on the drawing portion 9 of the recovery screw 42. The transporting directions of developer by the screws are in such a manner that the supply screw 46 and the recovery screw 42 are directed rightward in the figure, and the stirring screw 44 is directed leftward in the figure.

In the developing apparatus 4, in the drawing portion 9 by which developer is drawn, developer transported by the recovery screw 42 and the supply screw 46 to reach the right-end is pushed upward by the outward pressure generated by rotation of the recovery screw 42 positioned at the lowermost stage. Further, the developer is attracted by the inward pressure generated by rotation of the stirring screw 44 positioned at the uppermost stage. The delivery of developer is carried out smoothly. Therefore, the stirring and circulation of developer are well carried out, and no deviation of developer occurs.

According to the seventh embodiment, as described above, the centrifugal member 56 is provided on the drawing portion 9 of the recovery screw 42, and the radial member 55 is provided on the drawing portion 9 of the stirring screw 44. Thereby, in the drawing portion 9, the recovery screw 42 generates the outward pressure, and the stirring screw 44 generates the inward pressure. Therefore, developer transported by the supply screw 46 and the recovery screw 42 to reach the right-end is moved to the stirring screw 44 smoothly without staying. Thereby, the stirring and circulation of developer are well carried out, and no deviation of developer occurs, and the deterioration of image quality caused by unevenness and fog can be prevented.

In the foregoing, the drawing portion 9 is provided with both the centrifugal member 56 of the recovery screw 42 and the radial member 55 of the stirring screw 44, however, it may be effective to some extent by providing either the member 55 or the member 56.

[Eighth Embodiment]

Figure 18:
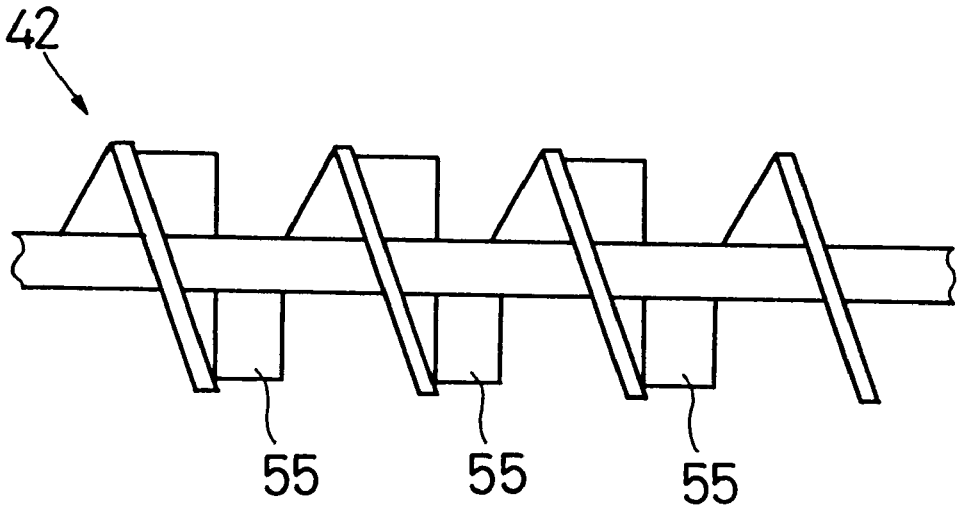
FIG. 18 shows a screw blade of a recovery screw for a developing apparatus according to the eighth embodiment.

A developing apparatus 5 according to the eighth embodiment has almost the same entire structure as a developing apparatus 2 according to the fifth embodiment (FIG. 10). However, a supply screw 46 for the developing apparatus 5 is the same screw as the recovery screw 16 (FIG. 14) according to the sixth embodiment. That is, the supply screw 46 has a centrifugal member 56. A stirring screw 44 is the same screw as the supply screw 14 (FIG. 12) according to the sixth embodiment. Further, as to a recovery screw 42, a screw whose screw blade is oppositely inclined to the screw blade of the supply screw 14 according the sixth embodiment is used (FIG. 18). That is, both the stirring screw 44 and the recovery screw 42 have radial members 55.

In the developing apparatus 5, the supply screw 46 generates outward pressure, whereas the stirring screw 44 and the recovery screw 42 generate inward pressure. Therefore, similar to the sixth embodiment, developer does not move one screw to other screw in the midst of transportation. Thereby, toner replenished from the toner replenishing port 40 is sufficiently stirred before supplied to the development roller 18. Further, the developer recovered by the recovery screw 46 is not directly supplied to the development roller 18 through the supply screw 46.

Since the supply screw 46 generates outward pressure, the supply screw 46 smoothly supplies developer to the development roller 18. Similarly, since the recovery screw 42 generates inward pressure, the recovery screw 42 smoothly recovers developer remained on the development roller 18.

Thus, in the eighth embodiment, the centrifugal member 56 is provided with the supply screw 46 to generate outward pressure by rotation of the supply screw 46, whereas a radial member 55 is provided with the stirring screw 44 and the recovery screw 42 to generate inward pressure by rotation of these screws. Aforementioned screws prevents developer from moving between the screws in the midst of transportation without providing a barrier plate between the screws. Thereby, deterioration of image quality caused by unevenness and fog is prevented. Moreover, supply and recovery of developer for the development roller 18 becomes smooth.

The case of the eighth embodiment may be combined with that of the seventh embodiment. More specifically, the centrifugal member 56 and the radial member 55 may be attached at the drawing portion 9 and other portions in different manner. Thereby, stirring and circulation of developer is carried out better.

[Ninth Embodiment]

Figure 19:
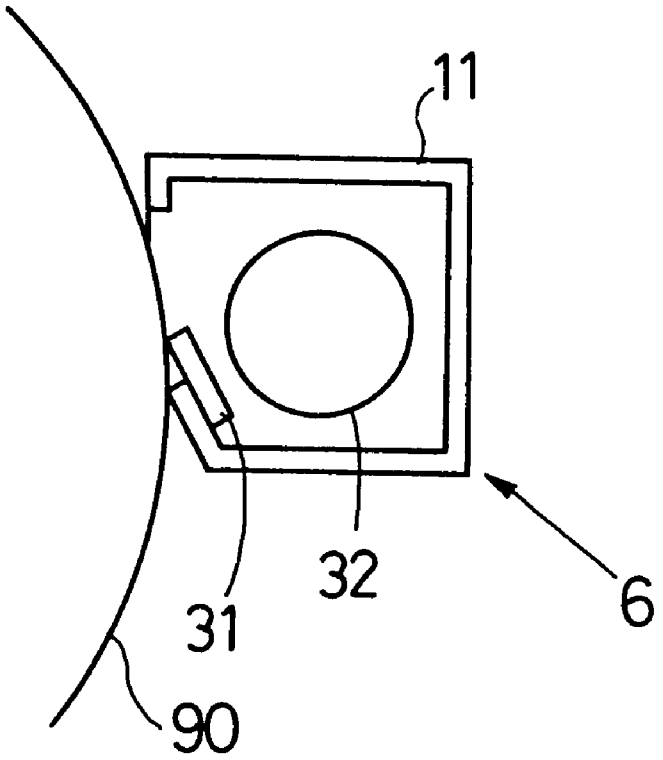
FIG. 19 is a sectional view showing the structure of a cleaning apparatus according to the ninth embodiment.

The ninth embodiment will be explained. In the ninth embodiment, the present invention is applied to a cleaning apparatus for a photosensitive body. A cleaning apparatus 6 according to the ninth embodiment includes a cleaning blade 31 for recovering developer remained on a photosensitive drum 90 after transfer, a storage tank 11 for storing developer recovered, and a transporting screw 32 for transporting developer to the storage tank 11, as shown in FIG. 19. The cleaning blade 31 formed of a rubber blade is pressed against the photosensitive drum 90 to scrape and remove developer remained on the photosensitive drum 90 by the mechanical force.

The transporting screw 32 is the same as the supply screw 14 in the sixth embodiment shown in FIG. 12. The transporting screw 32 has a radial member 55. The transporting screw 32 is controlled and driven from the main body of the image forming apparatus similar to the case of the screw in the aforementioned developing apparatus.

In the cleaning apparatus 6, developer remained on the photosensitive drum 90 after transfer is removed by the cleaning blade 31, caught by the transporting screw 32, and transported to the storage tank 11. In the transportation of the developer, since the transporting screw 32 is provided with the radial member 55 for applying the inward pressure to developer, when the transporting screw 32 rotates, the inward pressure is applied to developer. The developer is transported being rolled into internal of the transporting screw 32 by the inward pressure.

As described above, according to the present embodiment, since the transporting screw 32 is provided with the radial member 55 for generating the inward pressure by rotation thereof, the developer recovered by the cleaning blade 31 is transported being rolled into internal of the transporting screw 32. Thereby, occurrence of the smoke of toner in the cleaning apparatus 6 is prevented.

[Tenth Embodiment]

Figure 20:
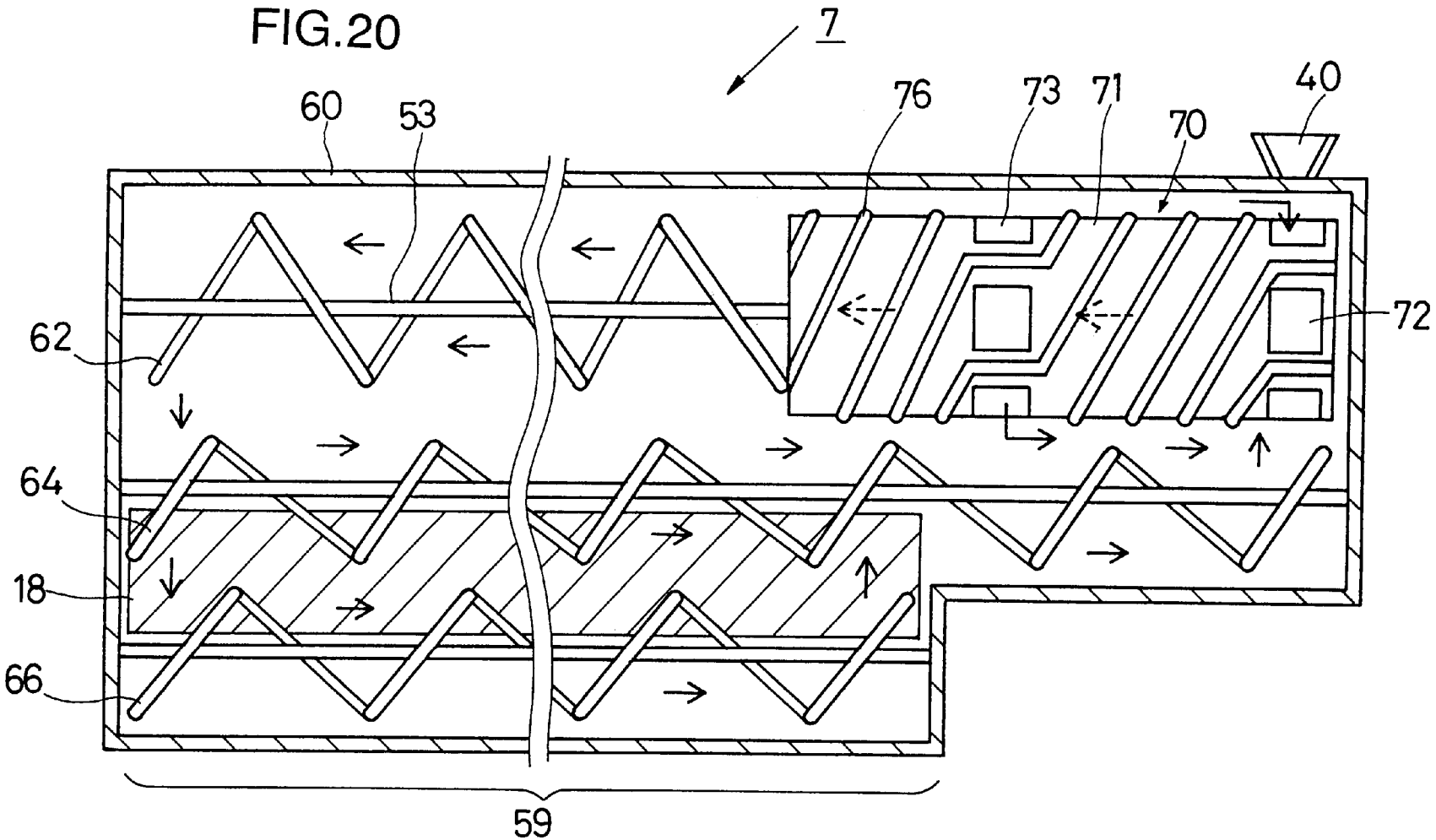
FIG. 20 is a sectional front view showing the structure of a developing apparatus according to the tenth embodiment.

In a developing apparatus 7 according to the tenth embodiment, a developer storage tank 60 for storing developer therein is interiorly provided with three screws, i.e., a stirring screw 62, a supply screw 64, and a recovery screw 66 in parallel with one another, as shown in FIG. 20. In any of these, a number of screw blades are diagonally provided on a rotatable shaft. These three screws are arranged vertically as shown in a sectional side view of FIG. 21. The stirring screw 62, the supply screw 64, and the recovery screw 66 are positioned on the upper stage, the middle stage, and the lower stage, respectively. A preliminary stirring portion 70 is provided on the extension at upstream (right-hand in FIG. 20) in the transporting direction of the stirring screw 62. Details will be explained later.

A development roller 18 is provided, at a height between the supply screw 64 and the recovery screw 66, with a part thereof projected from the developer storage tank 60. The development roller 18 is positioned in proximity to a photosensitive drum 90 of an image forming apparatus to impart toner to an electrostatic latent image on the photosensitive drum 90 to develop it.

Figure 21:
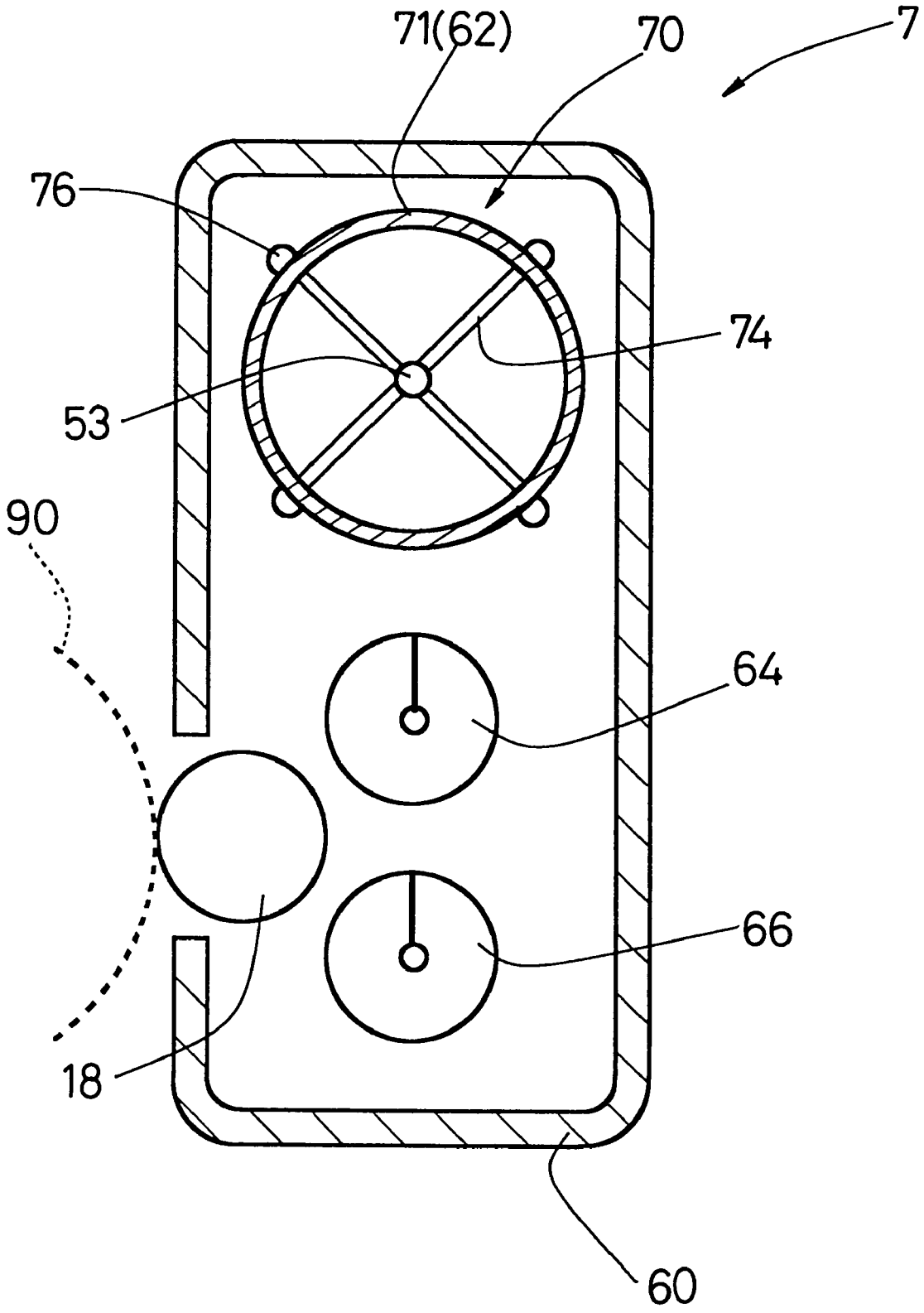
FIG. 21 is a sectional side view showing the structure of a developing apparatus shown in FIG. 20.
Figure 22:
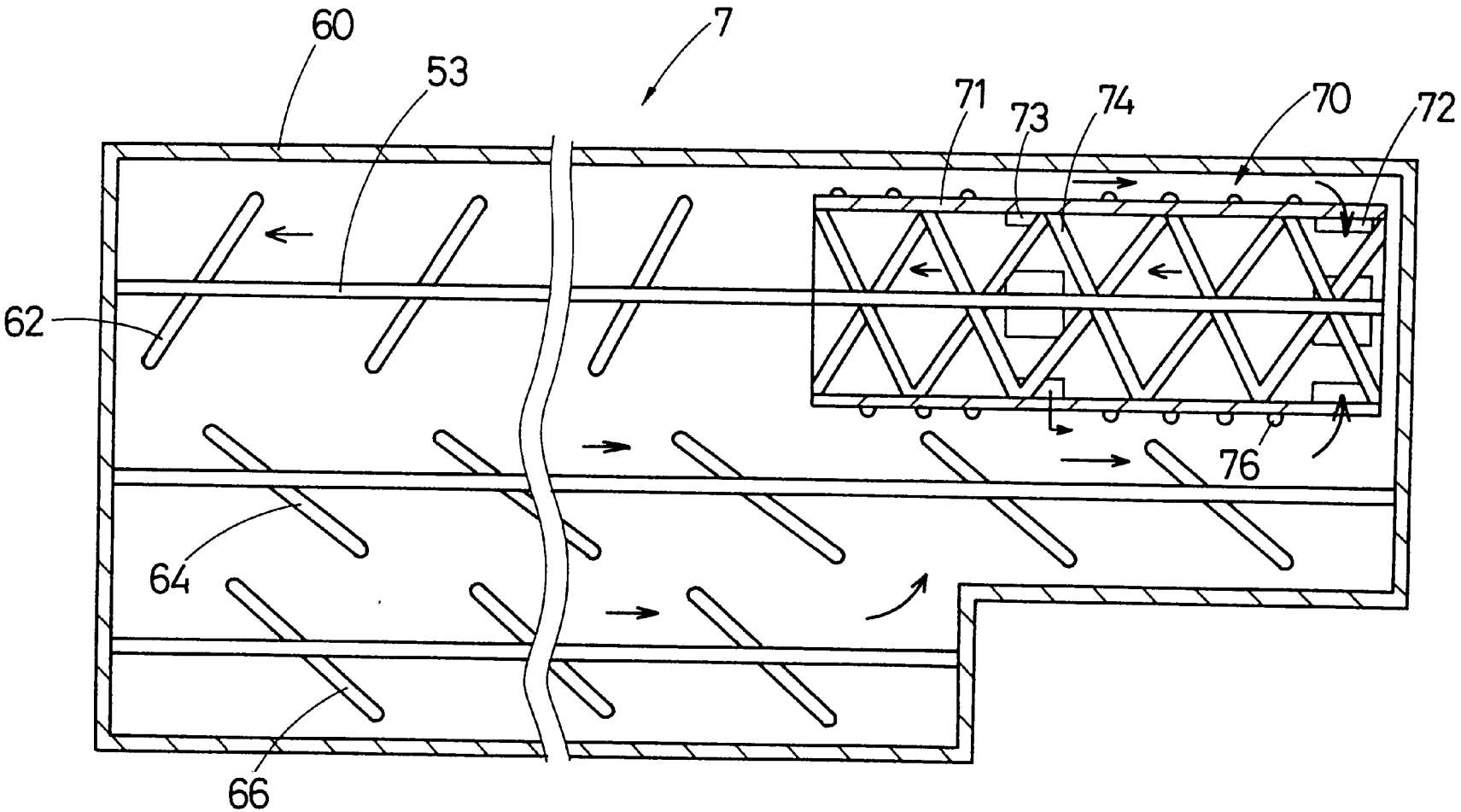
FIG. 22 is a sectional view showing the inside structure of preliminary stirring section of the developing apparatus shown in FIG. 20.

The preliminary stirring portion 70 includes an internal screw 74 provided on a shaft 53 common to the stirring screw 62, and a cylindrical body 71 provided outside the internal screw 74, as shown in FIGS. 21 and 22. The cylindrical body 71 is provided with a plurality of inlets 72 and outlets 73. An external screw 76 is provided outside the cylindrical body 71. The internal screw 74 and the external screw 76 are reversed in their transporting direction of developer. That is, the internal screw 74 transports developer leftward in FIG. 20, whereas the external screw 76 transports developer rightward in FIG. 20. FIG. 22 is a sectional view showing the structure of the interior of the preliminary stirring portion 70 in the developing apparatus 7.

The inlet 72 is a portion where developer flows in from the outside of the cylindrical body 71, whereas the outlet 73 is a portion where developer flows out from the interior of the cylindrical body 71 to the outside. The inlet 72 is positioned at a portion where developer is delivered from the supply screw 64, that is, at the end of the zone other than development zone 59. The outlet 73 is positioned at the end opposite thereto. The inlets 72 and the outlets 73 are arranged as described whereby the substantially entirety of the zones other than the development zone 59 in the developer storage tank 60 can be used to form a circulation route of developer. This can enhance the stirring efficiency of developer until it is supplied to the development zone 59. The development zone 59 means a zone where the development roller 18 is present in the latitudinal direction of the developer storage tank 60.

Further, a toner replenishing port 40 for replenishing toner into the developer storage tank 60 is arranged at a position directly above the inlet 72 provided at the cylindrical body 71.

In the developing apparatus 7, three screws, i.e., the stirring screw 62, the supply screw 64, and the recovery screw 66 are rotated by the control from the main body of the image forming apparatus. That is, the stirring screw 62 and the two other screws 64 and 66 are reversed in their rotational direction to each other. By this rotation, there occurs a flow of developer which is directed rightward in FIG. 20 for the supply screw 64 and the recovery screw 66, and directed leftward in FIG. 20 for the stirring screw 62. This flow causes the circulation of developer within the developing apparatus 7.

Figure 23:
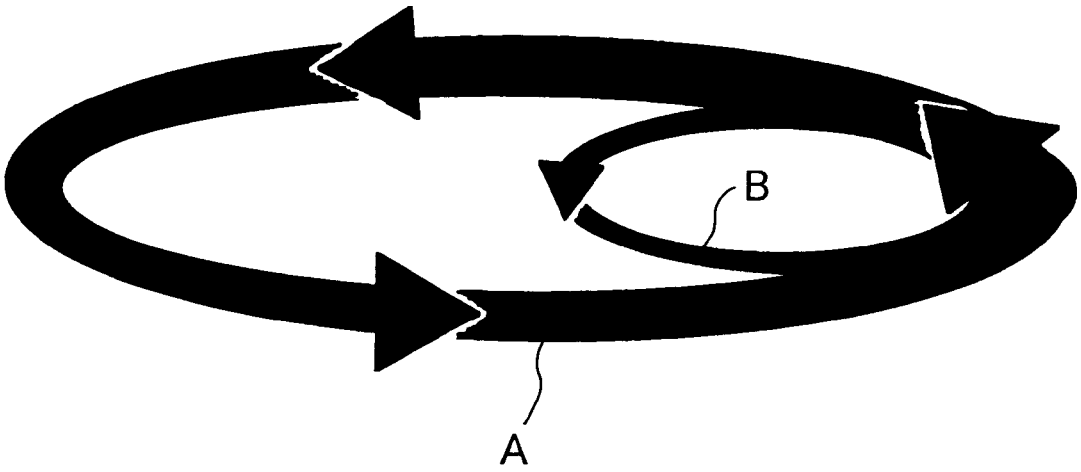
FIG. 23 shows circulation route of developer.

In the preliminary stirring portion 70, the internal screw 74 and the external screw 76 rotate together with the stirring screw 62. By this rotation, in the preliminary stirring portion 70, there occurs a flow of developer which is directed leftward in FIG. 20 for the internal screw 74 (interior of the cylindrical body 71) and directed rightward in FIG. 20 for the external screw 76 (exterior of the cylindrical body 71), as described above. This flow causes the circulation of developer within the preliminary stirring portion 70. That is, the developing apparatus 7, as shown in FIG. 23, has two circulation routes of developer, i.e., a circulation route A formed by the stirring screw 62, the supply screw 64, and the recovery screw 66, and a circulation route B formed by the preliminary stirring portion 70.

The operation of the developing apparatus 7 will now be described. By the control on the image forming apparatus, the stirring screw 62, internal screw 74, external screw 76, supply screw 64, and recovery screw 66 are rotated. Because of the transporting force by the each screw, there occurs the flow in the developer. The flow in the supply screw 64 and the recovery screw 66 is directed rightward in FIG. 20. Developer which has reached the right end in FIG. 20, that is, downstream end of the supply screw 64 and the recovery screw 66 overflows upward and moves to the cylindrical body 71. The developer moved to the cylindrical body 71 flows into the cylindrical body 71 from the inlet 72 and is transported leftward in FIG. 20 by means of the internal screw 74.

Thereafter, a part of developer within the cylindrical body 71 moves to the stirring screw 62. The flow in the stirring screw 62 is directed leftward in FIG. 20 similar to the flow in the cylindrical body 71. The developer which has reached the left end in FIG. 20, that is, the downstream end of the stirring screw 62 falls due to the gravity and then moves to the lower supply screw 64. Developer in the developer storage tank 60 is circulated counterclockwise in FIG. 20 (the circulation route A in FIG. 23).

On the other hand, developer within the cylindrical body 71 which is not moved to the stirring screw 62 flows out the exterior of the cylindrical body 71 from the outlet 73 and moves to the external screw 76. The flow in the external screw 76 is directed reversed to the interior of the cylindrical body 71, that is, directed rightward in FIG. 20. The developer which has reached the right end in FIG. 20, that is, the downstream end in the cylindrical body 71 again flows into the cylindrical body 71 from the inlet 72. Thereafter, a part of the developer moves to the stirring screw 62, as described above, while the other is circulated counterclockwise in FIG. 20 about the cylindrical body 71 (the circulation route B in FIG. 23).

In the circulation of developer, the preliminary stirring portion 70 and the stirring screw 62 take charge of the stirring of developer. That is, the toner density and charge of developer are made uniform. The supply screw 64 takes charge of supplying developer to the development roller 18 whereas the recovery screw 66 takes charge of recovering developer from the development roller 18.

Developer which has reached downstream of the supply screw 64 and the recovery screw 66 and moved to the cylindrical body 71 is sufficiently stirred by the circulation route B of developer formed by the internal screw 74 and the external screw 76. Developer which has moved to the stirring screw 62 without circulating the circulation route B is stirred by the internal screw 74 provided inside the cylindrical body 71. That is, when developer moves to the stirring screw 62, the developer is in a sufficiently stirred state. The developer which has moved to the stirring screw 62 is further stirred by the stirring screw 62, and after this, supplied to the supply roller 64, and further to the development roller 18. Accordingly, only the sufficiently stirred developer is supplied to the development roller 18 to obtain excellent quality of image without unevenness or fog.

The developer recovered by the recovery screw 66 from the development roller 18 is reduced in toner density in proportion to the amount of toner consumed by development. Therefore, when development continues, the entire developer gradually lowers in toner density. It is necessary that toner be appropriately replenished through the toner replenishing port 40.

The toner supplied through the toner replenishing port 40 falls into the inlet 72 of the cylindrical body 71 and flows into the cylindrical body 71. On the other hand, the developer moved from the supply screw 64 and the external screw 76 also flows into the inlet 72. The toner supplied through the toner replenishing port 40 joins the developer flowing into at the inside of the cylindrical body 71 and then the internal screw 74 stirs and mixes them together.

The toner immediately after the replenishment is not sufficiently mixed with the entire developer, and is insufficient in charge. However, since the toner immediately after the replenishment is held within the cylindrical body 71, the toner is not supplied to the supply screw 64 immediately.

That is, the toner is supplied to the development roller 68 with the following process: first, the newly supplied toner passes through the circulation route B of developer formed by the preliminary stirring portion 70; next, the toner is transported leftward in FIG. 20 by the stirring screw 62; then, the toner reaches the supply screw 64 and is finally supplied to the development roller 68. The newly supplied toner is sufficiently stirred, mixed and charged during the period of time.

When the supplied toner moves to the supply screw 64 from the downstream end of the stirring screw 62, the toner is sufficiently mixed with the entire developer to have the uniform toner density, as well as the excellent charged state. Accordingly, even when the toner supplied from the replenishing port 40, the sufficiently stirred developer is supplied to the development roller 68.

As described in detail above, in the developing apparatus 7 according to the tenth embodiment, the preliminary stirring portion 70 is provided on the extension at the upstream side of the stirring screw 62. The internal screw 74 and the external screw 76 for the preliminary stirring portion 70 are reversed in transporting direction of developer to each other. Therefore, in the preliminary stirring portion 20, the circulation route B of developer is newly formed. The toner replenishing port 40 is arranged at a position immediately above the inlet 72. The toner newly supplied is replenished into the cylindrical body 71. Accordingly, since only the sufficiently stirred developer is supplied into the development roller 68, excellent quality in image without unevenness or fog is obtained. Further, since the preliminary stirring portion 70 is provided within the developer storing portion 60, a preliminary stirring chamber is not required additionally. Thereby the developing apparatus does not get larger.

Figure 24:
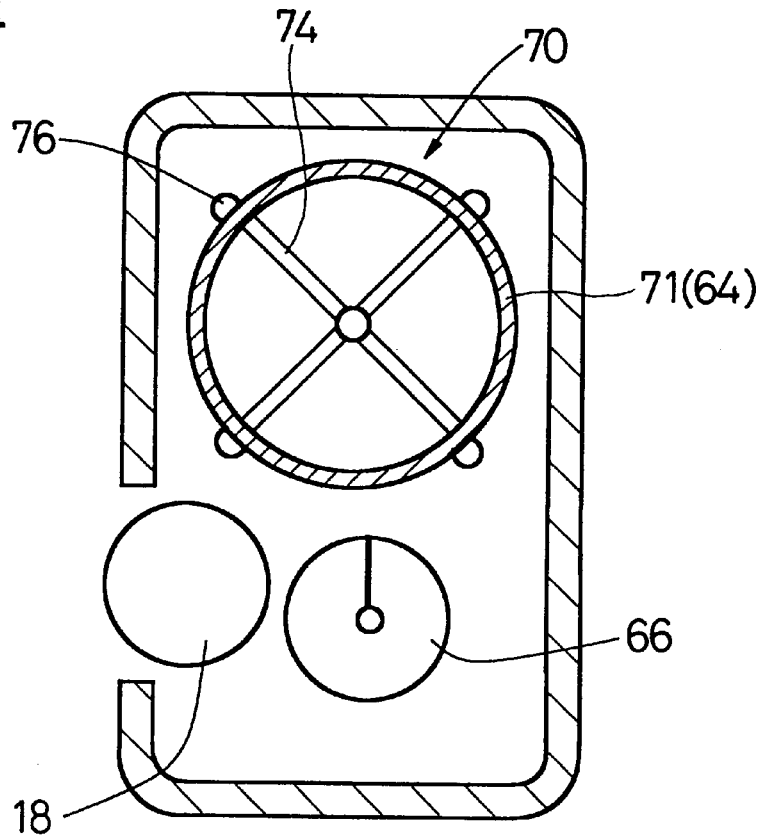
FIG. 24 shows a first variant of a developing apparatus according to the tenth embodiment.
Figure 25:
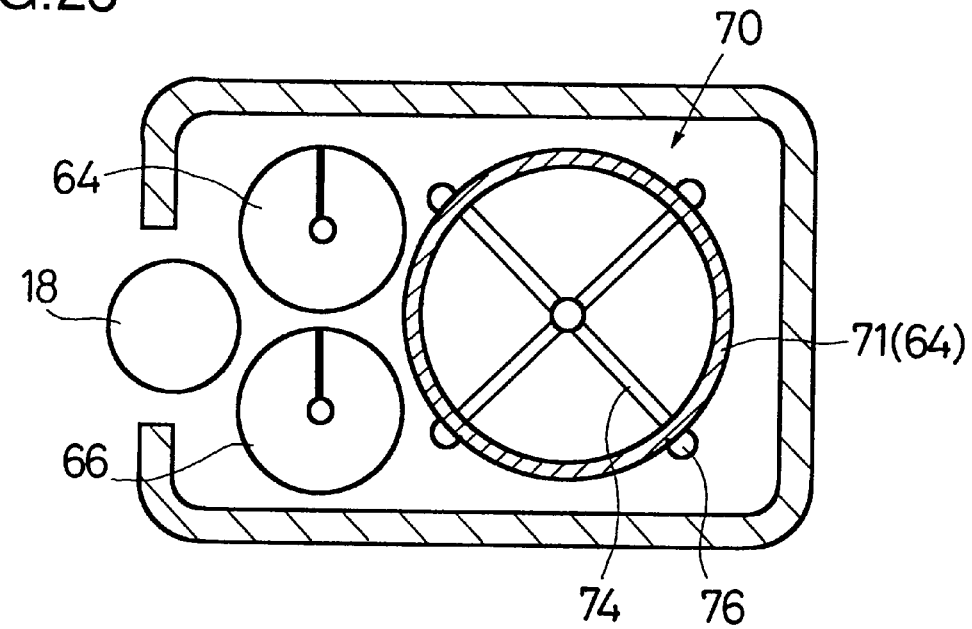
FIG. 25 shows a second variant of a developing apparatus according to the tenth embodiment.

According to the tenth embodiment, there may be a modification mentioned below. It can be applied to, what is called, a biaxial circulation developing apparatus without the stirring screw 62, as shown in FIG. 24. In this case, for example, the preliminary stirring portion 70 may be provided on the extension at the upstream side of the supply screw 62. Alternatively, the supply screw 64 and the recovery screw 66 may be arranged vertically, and the preliminary stirring portion 70 and the stirring screw 62 may be arranged at the height therebetween.

[Eleventh Embodiment]

Figure 26:
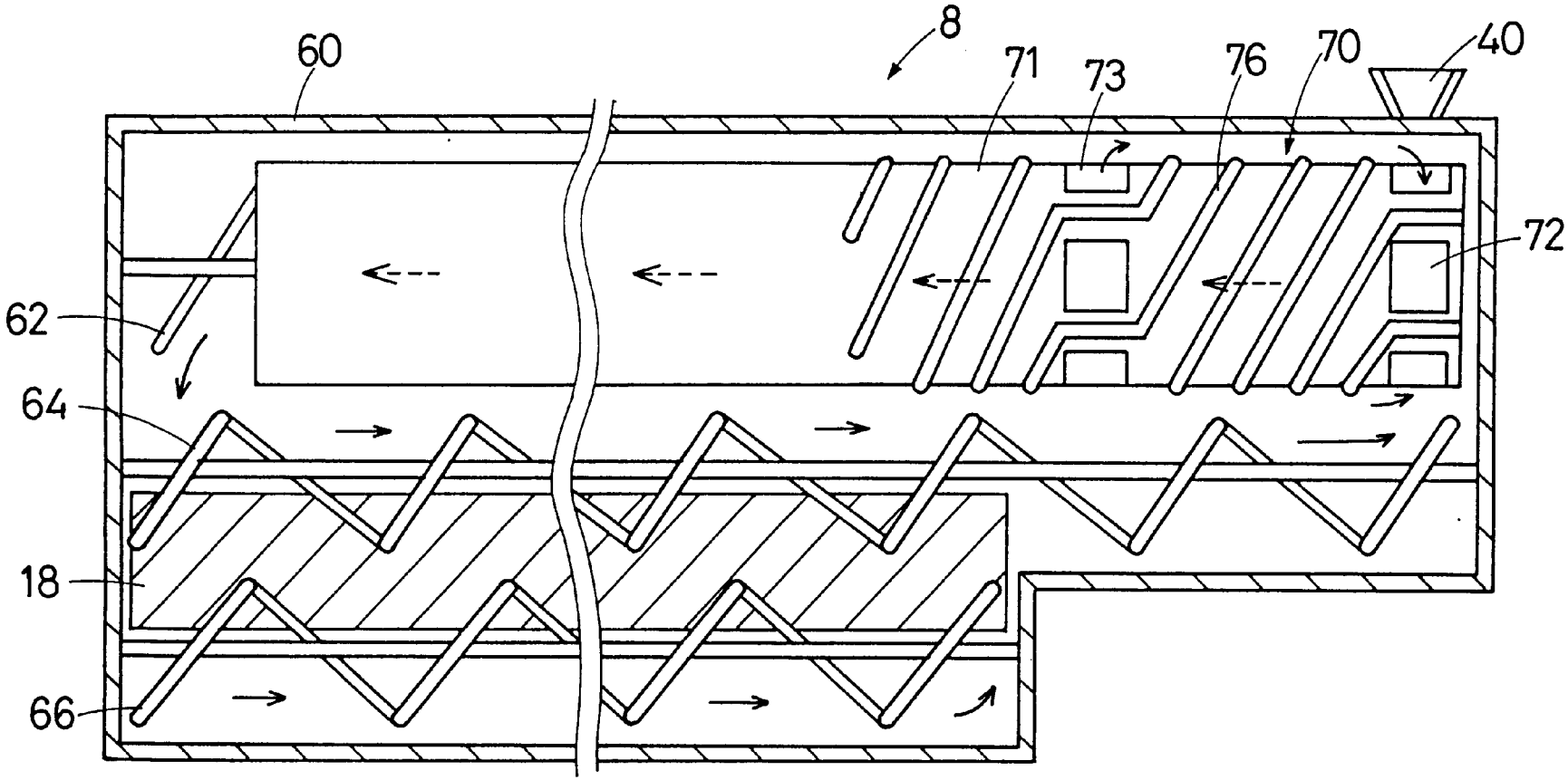
FIG. 26 is a sectional side view showing the structure of a developing apparatus according to the eleventh embodiment.

Next, the eleventh embodiment will be explained. The structure and operation of a developing apparatus 8 according to the eleventh embodiment is almost the same as those of the developing apparatus 7 according to the tenth embodiment as a whole, wherein only the details of a preliminary stirring portion 70 is modified. That is, as shown in FIG. 26, the length of the cylindrical body 71 is extended so that it covers the whole portion of the stirring screw 62. Other than that, there are not any differences.

In the developing apparatus 8, the developer which has moved to the preliminary stirring portion 70 through the downstream of the supply screw 64 and the recovery screw 66 is sufficiently stirred by circulation route B of developer formed by the preliminary stirring portion 70. Then, the developer which has moved to the stirring screw 62 without being circulated in the circulation route B is transported by the stirring screw 62 being kept inside of the cylindrical body 71. Since developer is kept inside when being transported, developer does not move to the supply screw 64 in the midst of transportation by the stirring screw 62. Accordingly, developer is transported passing the whole region of the stirring screw 62 and sufficiently stirred during the transportation. That is, by the time developer moves to the supply screw 64, developer is in a sufficiently stirred state. Further, since developer does not move to the supply screw 64 in the midst of transportation by the stirring screw 62, a barrier plate is not necessary. Since deviation of developer scarcely occurs, excellent circulation of developer is secured.

Moreover, toner supplied from a toner replenishing port 40 falls to an inlet 72 of the cylindrical body 71, then flows into the cylindrical body 71. On the other hand, the developer moving from the supply screw 64 and the external screw 76 also flows into the inlets 72. Thereby, the supplied toner joins the developer and then the toner and the developer are stirred, mixed together by the stirring screw 74 and finally charged.

The toner immediately after supplied does not sufficiently mix with the entire developer and is not charged enough. However, the toner immediately after supplied is held inside of the cylindrical body 71 without being supplied to the supply screw 64 immediately. That is, before being supplied to the development roller 68 through the supply screw 64, the newly supplied toner is transported via circulation route B of developer formed by the preliminary stirring portion 70, leftward entirely in FIG. 26 by the stirring screw 62. While being transported, the supplied toner is sufficiently stirred and mixed with the developer and then charged. Therefore, by the time the supplied toner moves to the supply screw 64 from downstream of the stirring screw 62, it is sufficiently mixed with the entire developer and the toner density becomes uniform. Thereby toner is sufficiently charged.

That is, in the eleventh embodiment, the length of the cylindrical body 21 is extended so that it covers almost whole part of the stirring screw 62. Thereby, developer is supplied to the supply roller 64 after being stirred reliably and sufficiently.

Figure 27:
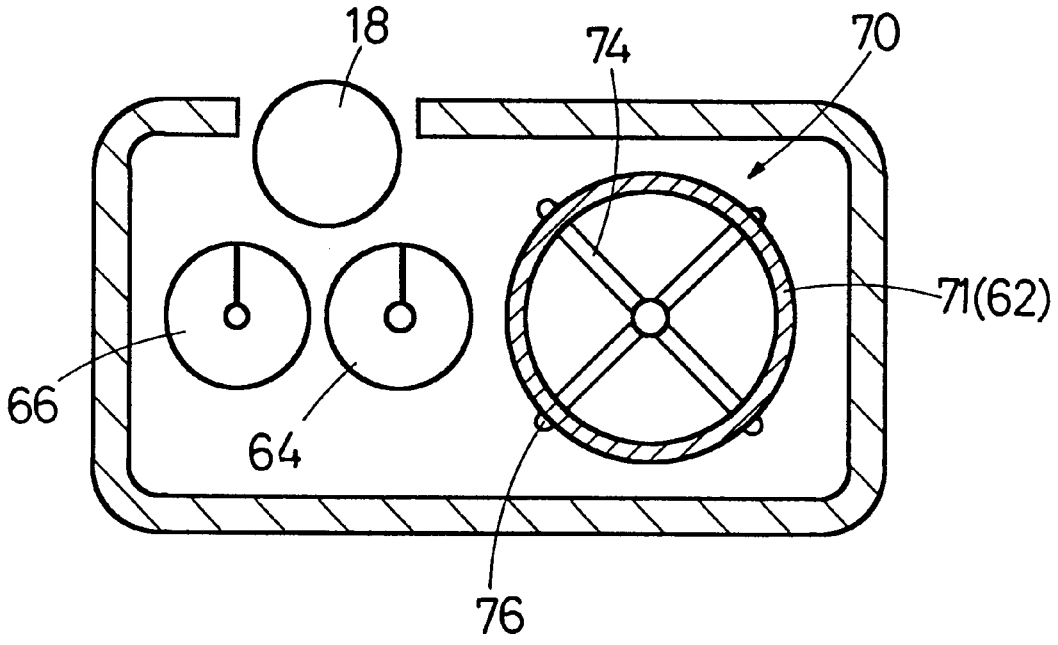
FIG. 27 shows a first variant of a developing apparatus according to the eleventh embodiment.
Figure 28:
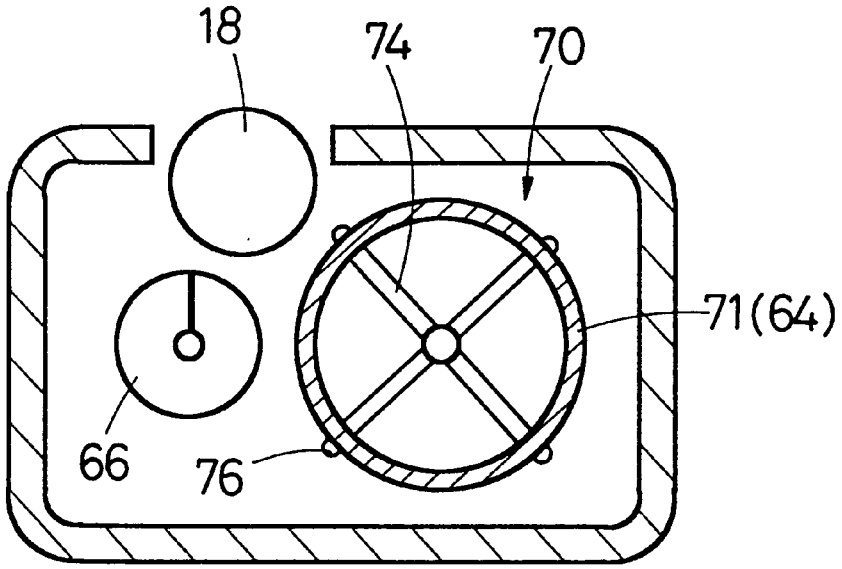
FIG. 28 shows a second variant of a developing apparatus according to the eleventh embodiment.
Figure 29:
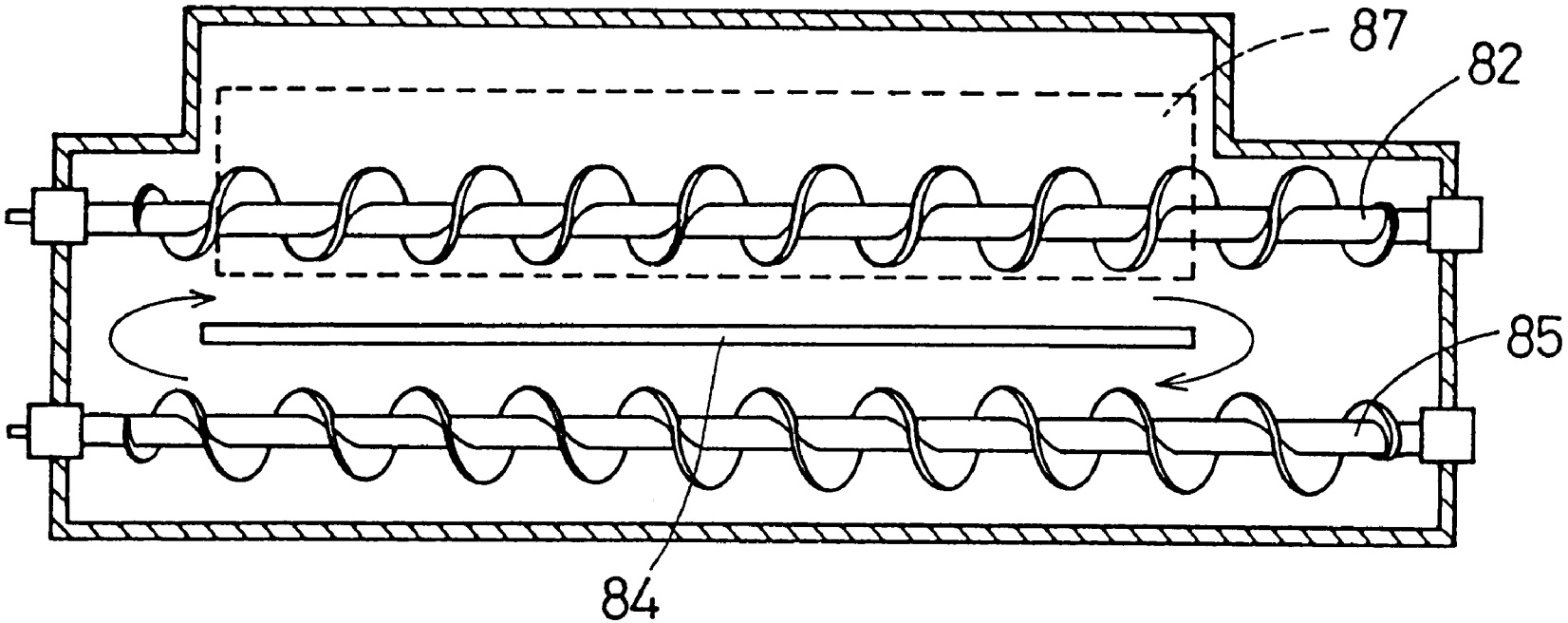
FIG.29 PRIOR ART
FIG. 29 shows the structure of a conventional developing apparatus.
Figure 30:
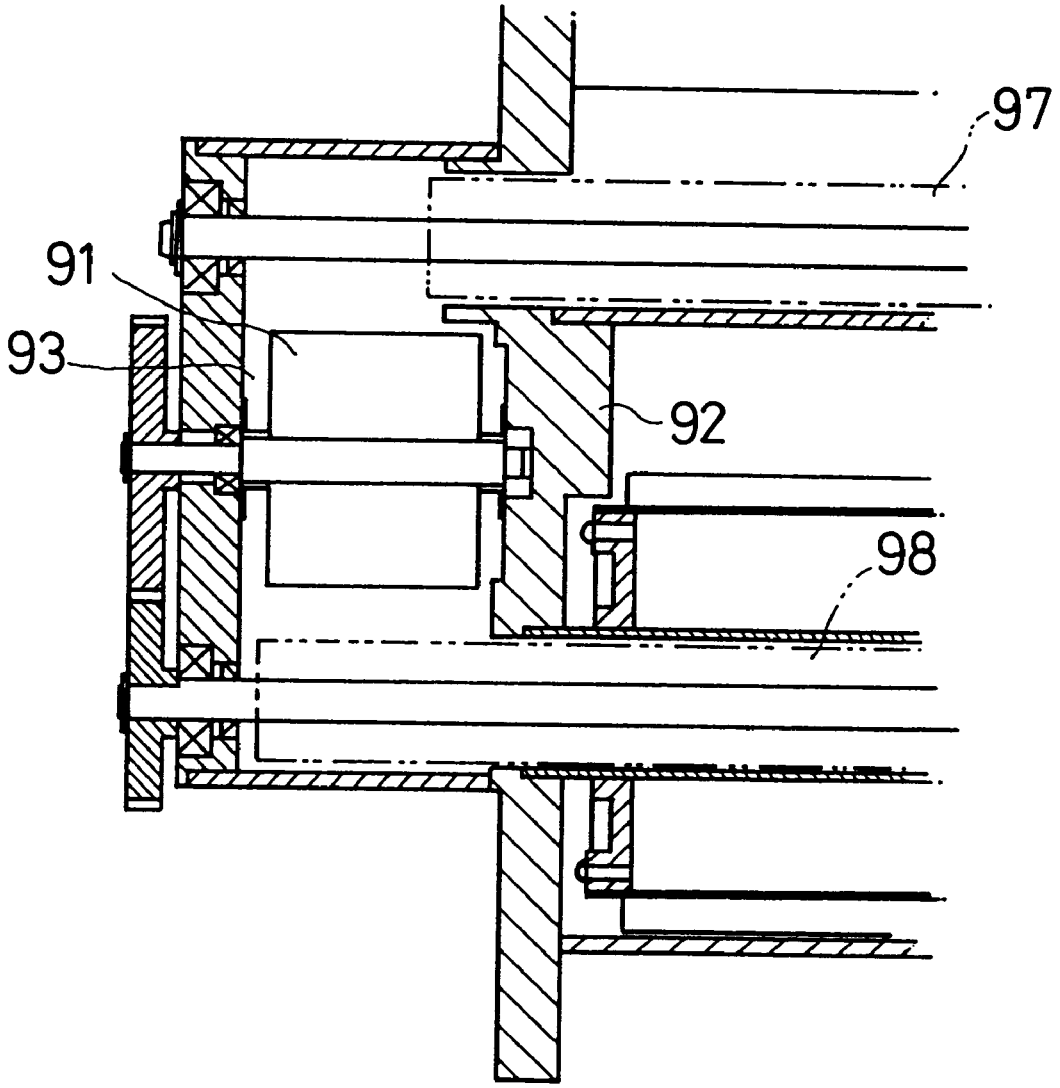
FIG. 30 shows the structure of another conventional developing apparatus.

According to the eleventh embodiment, there may be a modification mentioned below. For example, it can be applied to a biaxial circulation developing apparatus shown in FIG. 24, of course. It can be also applied to a developing apparatus shown in FIGS. 27 and 28 wherein each screw is positioned horizontally.

What is claimed is:

1. A developing apparatus to develop a latent image with developer including:

a first screw for transporting developer in an axial direction;

a second screw arranged above the first screw and for transporting developer in an axial direction; and means for generating a first component in a normal direction of pressure by rotation of the first screw and for generating a second component in a normal direction of pressure by rotation of the second screw, the first component being larger than the second component.

2. A developing apparatus according to claim 1, wherein rotational speed of the first screw is made faster than that of the second screw.

3. A developing apparatus according to claim 1, wherein the first screw has a pitch smaller than that of the second screw.

4. A developing apparatus according to claim 1, wherein the first screw includes more threads per unit length than the second screw.

5. A developing apparatus according to claim 1, wherein a paddle is provided on the first screw and no paddle is provided on the second screw.

6. A developing apparatus according to claim 1, wherein the first screw has a paddle having an area larger than an area of a paddle on the second screw.

7. A developing apparatus to develop latent image with developer including:

a development roller;

a first screw for, while transporting developer in an axial direction, supplying the developer to the development roller;

a second screw arranged below the first screw for recovering developer from the development roller to transport it in an axial direction;

a third screw arranged above the first screw and for transporting developer in an axial direction; and means for generating a first component in a normal direction of pressure by rotation of the first screw and for generating second and third components in a normal direction of pressure by rotation of the second and third screws respectively, the first component being larger than the second and third components.

8. A developing apparatus according to claim 7, wherein rotational speed of the first screw is made faster than that of other screws.

9. A developing apparatus according to claim 7, wherein the first screw has a pitch smaller than that of other screws.

10. A developing apparatus according to claim 7, wherein the first screw includes more threads per unit length than the other screws.

11. A developing apparatus according to claim 7, wherein a paddle is provided on the first screw and no paddle is provided on other screws.

12. A developing apparatus according to claim 7, wherein the first screw includes paddles, and at least one of the second and third screws includes paddles and an area of each of the paddles of the first screw is larger than areas of each of the paddles of the other screws.

13. A developer transporting screw which rotates about an axis to transport developer in an axial direction has a shaft and a screw blade projecting from the shaft and radial means for applying an inward pressure on the developer by centripetal force, the radial means projecting from the shaft and located between turns of the screw blade.

14. A developer transporting screw according to claim 13, wherein the radial means is a blade member including a generally concave front surface with respect to a direction of rotation of the developer transporting screw.

15. A developer transporting screw which rotates about an axis to transport developer in an axial direction has a shaft and a screw blade projecting from the shaft and a blade member including a generally convex front surface with respect to a direction of rotation of the developer transporting screw for applying an outward pressure on the developer by centrifugal force, the blade member projecting from the shaft and located between turns of the screw blade.

16. A developing apparatus including:

a development roller;

a plurality of developer transporting screws each rotating about an axis to transport developer in an axial direction and each having a shaft and a screw blade projecting from the shaft; and radial means arranged in an area of one of the developer transporting screws where developer is delivered from other developer transporting screws and applying an inward pressure on the developer by centripetal force, the radial means projecting from the shaft of the one developer transporting screws and located between turns of the screw blade of the one developer transporting screws.

17. A developing apparatus according to claim 16, wherein the radial means is a blade member including a generally concave front surface with respect to a direction of rotation of the one of the developer transporting screws.

18. A developing apparatus including:

a development roller;

a plurality of developer transporting screws rotating about an axis to transport developer in an axial direction and each having a shaft and a screw blade projecting from the shaft; and a blade member including a generally convex front surface with respect to the direction of rotation of the developer transporting screws, the blade member arranged in an area of one of the developer transporting screws where developer is delivered to other developer transporting screws and applying an outward pressure on the developer by centrifugal force, the blade member projecting from the shaft of the one of the developer transporting screws and located between turns of the screw blade of the one of the developer transporting screws.

19. A developing apparatus including:

a development roller;

a plurality of developer transporting screws rotating about an axis to transport developer in an axial direction and each having a shaft and a screw blade projecting from the shaft; and radial means arranged in an area where developer is recovered from the development roller by one of the developer transporting screws and applying an inward pressure on the developer by centripetal force, the radial means projecting from the shaft of the one of the developer transporting screws and located between turns of the screw blade of the one of the developer transporting screws.

20. A developing apparatus according to claim 19, wherein the radial means is a blade member including a generally concave front surface with respect to a direction of rotation of the one of the developer transporting screws.

21. A developing apparatus including:

a development roller;

a plurality of developer transporting screws rotating about an axis to transport developer in an axial direction and each having a screw blade wrapped around a shaft: and a blade member including a generally concave front surface with respect to a direction of rotation of the developer transporting screw, the blade member arranged in an area where developer is supplied to the development roller by one of the developer transporting screws and applying an outward pressure on the developer by centrifugal force, the blade member projecting from the shaft of the one of the developer transporting screws and located between turns of the screw blade of the one of the developer transporting screws.

22. A developing device which circulates and supplies developer to a developer carrier including:

a developer storage tank;

a plurality of transporting screws for transporting developer in an axial direction within the developer storage tank; and a preliminary stirring means for stirring developer, the preliminary stirring means having a cylindrical body provided inside the developer storage tank, an internal screw provided inside the cylindrical body and rotatable about an axis, and an external screw provided outside the cylindrical body and rotatable about the axis;

wherein a first transporting direction of developer by the internal screw and a second transporting direction of developer by the external screw are reversed with respect to each other.

23. A developing apparatus according to claim 22, wherein the preliminary stirring means is arranged on an extension of one of the transporting screws and the transporting direction of the internal screw is coincided with the transporting direction of the one transporting screw.

24. A developing apparatus according to claim 23, wherein the cylindrical body is formed with a passage hole through which internal and external developers can pass;

one end of the cylindrical body is positioned within a development zone; and the other end of the cylindrical body and the passage hole are positioned outside the development zone.

25. A developing apparatus according to claim 23, wherein the plurality of the transporting screws are arranged vertically.

26. A developing apparatus according to claim 24, wherein the plurality of the transporting screws are arranged vertically.

27. A developing apparatus according to claim 24, wherein the developer storage tank is formed with a replenishing port for replenishing developer so that developer replenished from the replenishing port flows into the cylindrical body.

28. A developing apparatus according to claim 26, wherein the developer storage tank is formed with a replenishing port for replenishing developer so that developer replenished from the replenishing port flows into the cylindrical body.

29. A developing apparatus according to claim 22, wherein the cylindrical body is formed with a passage hole through which internal and external developers can pass;

one end of the cylindrical body is positioned within a development zone; and the other end of the cylindrical body and the passage hole are positioned outside the development zone.

30. A developing apparatus according to claim 29, wherein the plurality of the transporting screws are arranged vertically.

31. A developing apparatus according to claim 29, wherein the developer storage tank is formed with a replenishing port for replenishing developer so that developer replenished from the replenishing port flows into the cylindrical body.

32. A developing apparatus according to claim 30, wherein the developer storage tank is formed with a replenishing port for replenishing developer so that developer replenished from the replenishing port flows into the cylindrical body.

33. A developing apparatus according to claim 22, wherein the plurality of the transporting screws are arranged vertically.

* * * * *